US005317300A

United States Patent [19]

Boesel

[11] Patent Number: 5,317,300

[45] Date of Patent: May 31, 1994

[54] ENCAPSULATED HIGH EFFICIENCY TRANSFORMER AND POWER SUPPLY

[76] Inventor: Robert P. Boesel, 1695 Valentine Ave., St. Paul, Minn. 55112

[21] Appl. No.: 724,926

[22] Filed: Jul. 2, 1991

Related U.S. Application Data

[63] Continuation-in-part of Ser. No. 492,821, Mar. 13, 1990, Pat. No. 5,088,186.

[51] Int. Cl.[5] ..... H01F 27/02; H01F 27/30

[52] U.S. Cl. ..... 336/96; 29/606; 29/609; 264/272.19; 336/192; 336/198; 336/210

[58] Field of Search ..... 336/96, 198, 208, 192, 336/210; 29/605, 606, 609; 264/272.19, 272.11

[56] References Cited

U.S. PATENT DOCUMENTS

| | | | |
|---|---|---|---|
| 3,117,294 | 1/1964 | Muszynski et al. | 336/192 |
| 3,243,746 | 3/1966 | Doggart et al. | 336/198 |
| 3,354,417 | 11/1967 | Davis | 336/96 |
| 3,559,134 | 1/1971 | Daley | 336/96 |
| 3,665,358 | 5/1972 | Leuck et al. | 336/198 |
| 3,979,707 | 9/1976 | Prince, Jr. | 336/192 |
| 4,000,483 | 12/1976 | Cook et al. | 336/192 |
| 4,151,500 | 4/1979 | Malerba et al. | 336/198 |
| 4,156,222 | 5/1979 | Rossman et al. | 336/198 |
| 4,183,002 | 1/1980 | Haslau | 336/192 |

*Primary Examiner*—Thomas J. Kozma

[57] ABSTRACT

A transformer or power supply apparatus as well as a method for making the same is provided. A coil assembly, including a bobbin (10 or 62), windings (30, 31), and terminals (27), retains core laminations (14) forming a transformer or power supply assembly. The assembly is placed within injection molding molds and a thermoplastic or thermosetting material is injection molded to partially or fully encapsulate the assembly, producing an improved transformer or power supply structure.

18 Claims, 13 Drawing Sheets

FIG. 1A
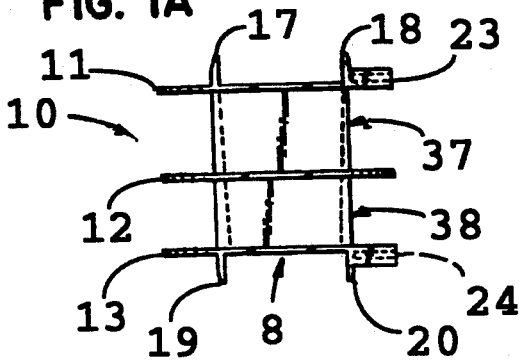
FIG. 1B
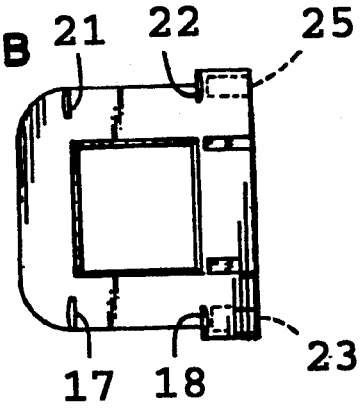
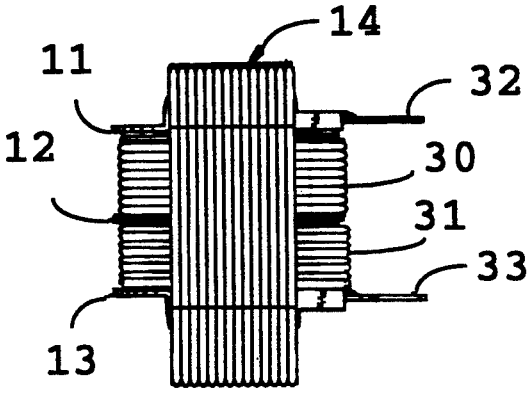
FIG. 2A
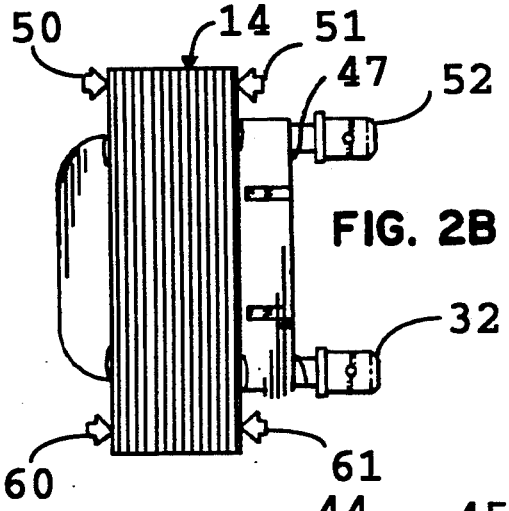
FIG. 2B
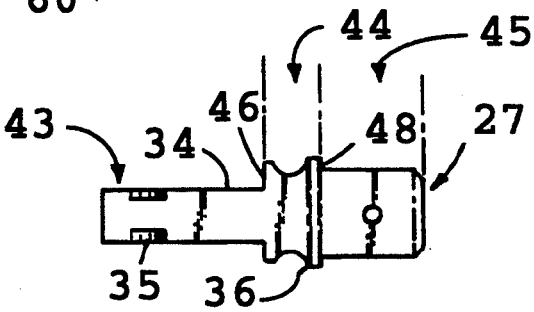
FIG. 4
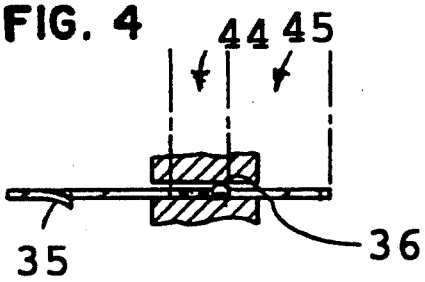
FIG. 5

ENCAPSULATED HIGH EFFICIENCY TRANSFORMER AND POWER SUPPLY

This is a continuation-in-part of U.S. Ser. No. 07/492,821, now U.S. Pat. No. 5,088,186 filed Mar. 13, 1990.

FIELD OF THE INVENTION

The present invention relates to transformers and power supplies and more particularly to encapsulated transformers and power supplies exhibiting high electromagnetic and thermal efficiency. A total encapsulation construction may be used for wall plug-in, wall hung, direct burial, or other applications requiring total insulation of all conductive surfaces of the transformer. The invention applies to DC power supplies as well as AC power supplies, and to plain power transformers.

BACKGROUND OF THE INVENTION

Power transformers are widely used for voltage conversion and include primary and secondary windings which are physically separated from each other. The windings are coupled electromagnetically through a ferromagnetic core. Various construction techniques have been adopted to meet the mechanical and electrical requirements of various transformer designs. For example, the use of a unitary bobbin having three flanges which permits the winding of both primary and second coils on the same bobbin is known. The aperture of the bobbin fits over the middle leg of an E-core transformer winding. The use of injection molding encapsulation for paper-wound flyback transformers and the like is taught by U.S. Pat. No. 3,626,051. The encapsulation of current transformers is known from U.S. Pat. No. 4,199,743. These patents address the numerous problems which must be overcome to encapsulate a transformer assembly, however, encapsulation of power type transformers has not been performed.

It is known that power transformers are not perfectly efficient and that resistive losses in the windings result in the generation of heat in the transformer assembly. Other sources of heat include core losses which result in heating of the core material. It has been conventional to expose as much of the windings as practical to the air as an aid in the dissipation of this heat. Totally insulated power supplies which are employed in DC and AC power supplies are generally produced as an assembly including a plastic housing, transformer, internal wiring, strain relief for the secondary and primary cords (if used), and electronic devices and/or thermal protective devices.

The transformers used in the above applications generally are produced by prior well known technologies. This includes tape insulated primary and secondary windings which interfere with the elimination of heat produced in the windings. This condition is aggravated by then enclosing the transformer within a plastic or metal housing which greatly increases the difficulty in the elimination of heat by nature of trapping a large air volume around the transformer, and by the thermal insulation value of the housing itself. Major disadvantages of prior known transformers include this poor thermal performance, the high volume required of the total assembly compared to that of the transformer itself, the high cost of the materials for the power supply, the high labor costs for the assembly of all the components, and the high risk of quality defects associated with the large number of components and operations required for their assembly. In the case of wall plug-in power supplies, the thermal and volume disadvantages combine to severely limit the power which can be produced in these designs.

Therefore, there is a need for an encapsulated transformer or power supply which can be employed in a safe and economical manner which overcomes the above problems.

SUMMARY OF THE INVENTION

The present invention teaches a transformer or power supply design, and manufacturing techniques which result in a partially or fully encapsulated transformer, or a fully encapsulated power supply. Both the mechanical design and assembly method result in an improved encapsulated transformer and power supply. The construction uses a three flange bobbin to locate and retain I and E core lamination members during mechanical assembly operations. The three flanges may be spaced to provide a wide winding form and a narrow winding form which are adjacent to each other.

In one embodiment, a bobbin aperture fits around the center leg of the transformer core member and has tapered walls. The taper has both electrical and mechanical significance. Electrically, the tapering may be used to place more dielectric material between the magnetic core material and the windings wrapped on the form, approximate the small end of the taper. Typically, the transformer will be designed with the high voltage winding on the small end of the taper. Mechanically, the taper permits the selective assembly of alternating core pieces into the bobbin and permits retention of these core pieces by compression during subsequent manufacturing operations.

The "assembled" transformer is placed between two injection molds for partially encapsulating the transformer wherein the transformer core becomes a third mold element. In this context, an "assembled" transformer consists of a core with completed windings having the required magnetic core material assembled into the tapered aperture. The core with completed windings includes electrical terminal connectors. These elements serve a dual function as well. The terminal connectors are physically retained in slots formed in the unitary bobbin. The terminal connectors can be soldered or otherwise coupled to the windings in a conventional fashion to electrically couple the windings to the connectors.

The terminal connectors each have a specialized sealing structure which prevents flashing of plastic out of the mold during the injection process, yet permits the venting of air from the mold. The injection of a thermoplastic or thermosetting material into the mold cavity through windows formed by the bobbin results in a transformer with substantially completely encapsulated windings and results in a mechanically stable structure which provides improved mechanical, electrical and thermal properties.

Mechanically, the compaction of the core lamination during the injection results in a conformal plastic clamp which retains the core in the compacted state after removal from the mold. This feature eliminates transformer "buzzing" and it improves the electrical performance of the transformer as well. Electrically, the alternating assembly of E and I cores as well as the compaction reduces the air gaps associated with the transformer core material, improving magnetic performance.

Thermal performance is enhanced by the reduction in resistance and magnetic losses coupled with the improved thermal conductivity provided by the encapsulant.

In another embodiment, a fully encapsulated transformer or power supply is provided in which the encapsulant substantially covers both the core laminations and the windings. A bobbin has extended tabs protruding from the bobbin flanges which transmit a compressive force to the core assembly from fully closing mold halves. The indirect compression of the core material results in a large force contributing to immobilize the assembled transformer within the closed mold. The bobbin further contains mold locating surfaces which are used to accurately center the transformer within the encapsulation mold. These provide accurate placement of the transformer within the encapsulant without using mold core pins contacting the core plate assembly. Also, a ground wire passage through the coil bobbin to a ground core in the encapsulated design of the present invention is also provided.

Further features of the present invention include output/input cord protection by the use of primary and secondary cord passages in the bobbin which protect insulated wire from the melt temperature used in the molds during the injection molding of the encapsulant. Minimum height terminals are also employed to provide strain relief in electrical connection to magnet wire. Encapsulant flow passages are also formed by combining the features of the coil bobbin and the encapsulation mold, which merge to provide flow passages and a reception chamber for the arriving encapsulant which avoids damage from violence associated with high injection velocity through small nozzle orifices. Integral component compartments can be formed during encapsulation for housing peripherals or support devices.

A high efficiency fully encapsulated power transformer or power supply apparatus comprises a magnetic core member having a plurality of E and I core pieces and a unitary bobbin having a plurality of terminal receiving slot means. The bobbin has a first flange, a second flange, and a third flange, wherein the first and second flanges form a first winding form, and the second and third flanges form a second winding form. The bobbin includes walls forming a tapered central aperture for accepting and retaining the core member pieces, with the bobbin having a plurality of extended tabs protruding from the first and third flanges. A first wire winding is employed on the first winding form and a second winding is on said second winding form. A terminal means is inserted into the terminal slot means for electrical connection to the first and second windings. A bobbin and core member encapsulation formed of a thermoplastic or thermosetting material substantially covers and substantially conforms to the bobbin and core member.

By nature of the encapsulant totally covering all conductive surfaces, no housing for the transformer is required. This results in a transformer or power supply which is slightly greater than the volume of the transformer within, which is cooled directly by the ambient air and which eliminates many of the components and assembly operations of prior transformers and power supplies. The present invention results in a smaller, cooler operating, and lower cost transformer and power supply. Another benefit is the ability of the present invention to produce approximately five times as much power in a wall plug-in power supply as compared to prior devices.

A method of making a fully encapsulated transformer or power supply apparatus comprises the steps of forming a first and second winding on a unitary bobbin, with the unitary bobbin having a central bobbin aperture, and assembling core laminations into the bobbin, thereby substantially completely filling the central bobbin aperture and forming an assembled transformer or power supply apparatus. The assembled apparatus is then placed within conformal injection molds wherein it is completely enclosed by the molds, with the apparatus and the molds forming encapsulant flow passages and a reception chamber for the arriving encapsulant for avoiding damage from the violence associated with high injection velocities through a small nozzle orifice. The assembled apparatus is then compressed within the conformal molds by applying force to the core laminations. A thermoplastic or thermosetting encapsulant material is then injected into the mold into conformity with the mold cavity and flow passages, wherein the windings are compressed and mechanically and thermally joined to the core laminations. The encapsulant substantially covers and conforms to the bobbin and the core laminations.

One aspect of the invention is the novel, encapsulated power transformer or power supply apparatus. Another aspect of the invention is a method of making the encapsulated transformer or power supply. These and other features will become apparent from a consideration of the following description of the invention and accompanying drawings which form a part of this application, in which there are illustrated and described preferred embodiments of the invention.

BRIEF DESCRIPTION OF THE DRAWINGS

In the drawings, in which like reference numerals indicate corresponding structures throughout the views:

FIG. 1A is an elevational view of a bobbin of the invention;

FIG. 1B is a top view of the bobbin shown in FIG. 1A;

FIG. 2A is an elevational view of the core lamination assembled onto the bobbin;

FIG. 2B is a top view of the core lamination assembled into the bobbin;

FIG. 4 is a top view of a quick connect tab used for electrical connection to the winding;

FIG. 5 is a side elevational view of a quick connect tab used for electrical connection to the windings;

DETAILED DESCRIPTION OF THE INVENTION

In the following detailed description of the preferred embodiments, reference is made to illustrative embodiments of the invention. It is to be understood that other embodiments may be utilized without departing from the scope of the present invention.

I. Overview of the Invention

Figure 7:
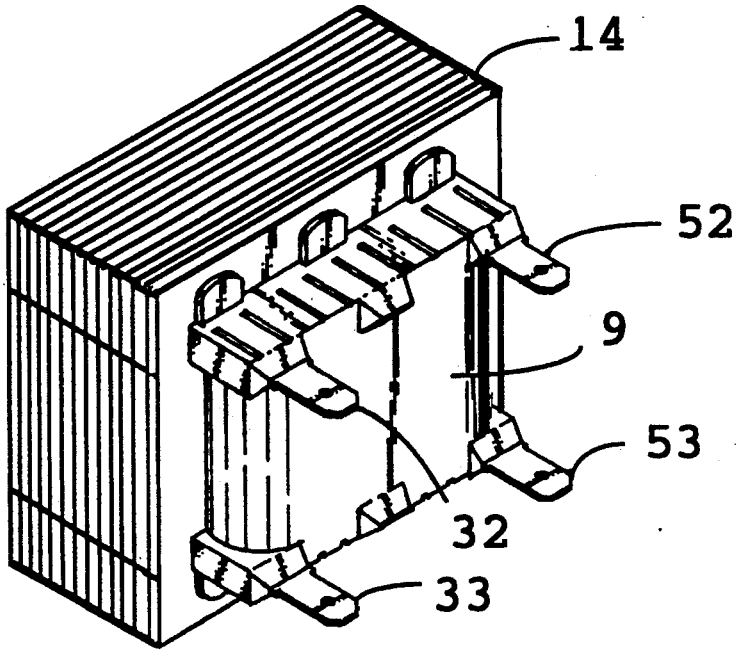
FIG. 7 is a perspective view of a completed partially encapsulated transformer.

The transformer structure is based upon a unitary bobbin shown in FIG. 1 and FIG. 8. The bobbin 10 has three flanges forming two winding forms shown in FIG. 1A as 37 and 38. Wire is wound on these forms forming the transformer primary and secondary windings as shown as 30 and 31 in FIG. 2A. The windings are typically terminated in four electrical connections shown in the FIGS. 32, 33, 52, and 53. The terminals 27 have a sealing structure 36 shown in connection with FIG. 4 and FIG. 5. The "assembled" transformer as depicted in FIGS. 2A and 2B is loaded into an injection molding machine which is depicted schematically in FIG. 6A and 6B. After the completion of the molding process, the "finished" transformer, as shown in FIG. 7, is ejected.

The interior surface of the injection mold follows the general contours of the bobbin 10 and lamination core 14 closely so that the encapsulation process results in a substantially conformal coating of the assembled transformer. The electrical terminals 27 are exposed for electrical connection while the primary 30 and secondary 31 windings are substantially completely encapsulated by the plastic material 9. In another embodiment shown in FIGS. 12–14, a transformer or power supply is fully encapsulated.

The preferred encapsulant material is a polyethylene terephthalate (PET) material sold by DuPont, of Delaware under the tradename "Rynite".

II. Transformer Assembly

Briefly, the stepwise sequence for assembling the transformer involves first winding the high voltage 30 and low voltage 31 windings onto the specialized three flange bobbin 10. The bobbin 10 has four retainer slots 23–26 for positioning and retaining four electrical terminals 32, 33, 52, 53. The terminals are inserted into the slots and they are electrically connected to the windings. The bobbin 10 is particularly useful in forming a transformer which is partially encapsulated, with the encapsulant covering the windings and bobbin but leaving exposed the core laminations.

The bobbin has a tapered core receiving aperture 8, which permits numerous individual E-core and I-core sections 15 and 16 to be assembled into the bobbin for filling the core receiving aperture 8. Selective assembly of alternating core sections is followed by a compaction process. The compaction process is followed by the insertion of additional core pieces which results in a very tight fit between the core sections and the bobbin which permits the bobbin aperture 8 to be substantially completely filled. Two benefits result from the selective insertion of additional core material after compaction. The first benefit is that the air gaps between the separate pieces of the core are greatly reduced which improves the magnetic performance of the transformer. The second benefit is that the winding form has a greater weight of magnetic material encompassed within its electric field resulting in improved current utilization by the transformer.

Compaction and the subsequent insertion of supplemental core pieces can be exploited in another way as well. In general magnet steel is supplied in varying grades. Cold rolled steel is the lowest grade, with silicon steel and grain oriented silicon steel representing higher performance material per unit weight. The present invention contemplates that the grades of steel may be mixed to achieve a requisite level of performance. Mixing grades may be used to control the price performance characteristics of the completed transformers.

Completely filling the aperture permits the bobbin to retain, locate and position the transformer elements for the injection molding step. The completion of the core insertion process produces a freestanding and electrically complete transformer, which is ready for injection molding. This freestanding transformer is referred through the specification as an "assembled" transformer.

The individual design features and manufacturing steps described briefly above may be understood in greater detail as follows:

FIG. 1 shows the bobbin 10. The bobbin has first 11 second 12 and third 13 flanges. The flanges form two spools for receiving windings. For example, in the illustrative design shown herein, the wider spaced spool may be used for the higher voltage winding, while the narrower spool may be used for the lower voltage winding. The bobbin has a hollow core or aperture 8 which is shown in a phantom view. The taper of the hollow core is exaggerated for clarity, illustrating its linear shape. The taper is required to permit manual assembly of the core laminations into the bobbin 10. Although a linear taper of all four walls of the aperture is shown in FIG. 1A, it should be appreciated that the taper can take other forms as well.

Figure 3:
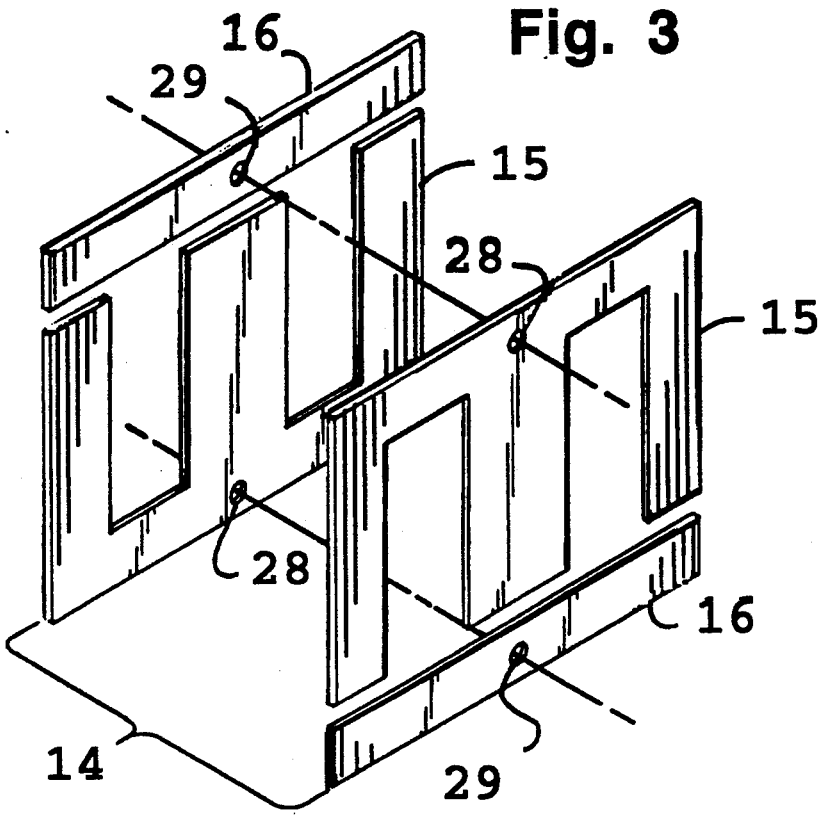
FIG. 3 is a perspective view of the core lamination.

FIG. 2A shows the spools wound with their appropriate windings. The windings may be of any appropriate magnet wire, such as copper or aluminum wire. The high voltage winding 30 ends in leads which are soldered or otherwise connected to the terminal connectors 32 and 52. The lower voltage winding 31 likewise is terminated in corresponding connectors 33 and 53. E-core 15 and I-core 16 lamination pieces are assembled into the bobbin 10. It is preferred to stack the E and I cores alternately so that each I-core lies between adjacent E-core segments. This configuration is depicted in FIG. 3. An alternate, but less efficient assembly would be to but-stack, or but-stack and weld the E and I-cores. FIG. 3 shows each core segment having an aperture 28 or 29 located therein. Typically these apertures are produced by the lamination stamper and are used to locate the pieces during manufacture and shipping.

It is desirable to fill the bobbin with the maximum number of core laminations. This is desirable in the present instance for both mechanical and electrical reasons. Electrically, transformer performance is enhanced by the inclusion of additional core material within the aperture 8. Mechanically, the transformer may be easily handled for subsequent processing if the core laminations are firmly secured within the bobbin. This desirable condition is achieved by selective assembly of the core structure. The selective assembly process results in the elastic deformation of the lamination pieces such that they are held into position. The alternation of E and I core pieces called for by this assembly technique coupled with the burrs on the E and I core pieces in conjunction with the assembly process result in a core structure which is thicker at the edges than at the middle.

E and I-core sections 15 and 16 are created by a stamping operation. Stacks of these cores are used to assemble transformer frames. Typically, transformers are manufactured according to industry standard frame sizes with a typical "one inch" stack height transformer core having between 0.85 and 0.95 inches of solid steel. In practice, processing variations of the core materials results in variable thicknesses and therefor a variable stack height. These variations are due to thickness variations and stamping burrs. Two distinct arises form on the surface of the stamped core section. These two distinct conditions are called "rollover" and "burr". The "rollover" arise is the result of material deformation as the stamping punch enters the material and is characterized as a "rounded edge." The "burr" arise is the result of the force applied by the stamping punch exceeding the shear strength of the material and is characterized as a raised "sharp edge." The surface of the lamination between the arris, has two conditions known as "land" and "breakout". The land portion is characterized by a shiny, relative smooth but striated condition, while the breakout portion is characterized by a dull, rough surface. It is important to note that the land and breakout surfaces are not coplanar and the breakout surface is especially not perpendicular to the rolled surface of the lamination. Thus, even if one stacks laminations in perfect registration, the surfaces produced by stacking will be highly irregular as a result of the nature of the stamping process.

The burr arris exhibits a protrusion of material above the plane of the rolled surface of the lamination. Thus, a thickness measurement including the burr arris within the anvils of the micrometer will exceed a similar measurement where the anvils are totally within the stamped shape. When the "E" and "I" core components are assembled in alternating fashion in accordance with the teaching of this invention, the burr on each core section 15 and 16 adds to the volume of the core as it is assembled. Traditionally, this occurrence is known as "stacking factor", and is usually expressed as a percentage of the volume within a core assembly which is composed of iron or other magnetic metal, the balance being a void of magnetic material as a result of the accumulation of burrs on the components. The stacking factor is a material consideration in the design of the transformer since it is the cross sectional area of the magnetic material which determines how much magnetic flux can be conducted for any particular magnetic material. Stacking factors on the order of 85% are not uncommon.

A less efficient prior solution to the stacking problem has been to stack a number of E cores together and to weld a like number of I cores to form a transformer frame. In contrast, the present invention alternates E and I cores to achieve magnetic efficiency while reducing undesirable air gaps.

A second condition adds to the detrimental effects caused by the stacking factor, and that is that the individual laminations are never perfectly flat. The steel sheet used for producing lamination is produced by rolling, and then wound into coils for storage and shipment. The coiled sheet develops a curvature parallel to the rolling direction which remains even after the coil is unwound called "coil set". The coil also develops a curvature perpendicular to the rolling direction called "camber". Before the material is stamped into individual lamination components, the rolled coil must be slit to the width required by the particular stamping die to be employed. The coil is unrolled for the slitting process and the individual coils are rerolled after slitting. The slitting process itself can add to the out-of-flat condition.

An attempt is made to flatten the surface of the stock prior to stamping through the use of stock straighteners which employ opposing rolls to alternatively cause the stock to bend first one direction and then the other, in decreasing amounts until the stock emerges from the straightener in a more flat condition. The stock is then stamped into individual lamination components, with the stamping process contributing to additional out of flat condition as well as the tendency for some lamination features to be bent out of the plane of the balance of the component. It is important to note that the lamination components are collected in sequence and orientation as they are stamped, with lots of lamination so produced retained by wire strung through holes stamped for this purpose. In most cases, an annealing process is performed on the lamination to relieve the stress induced in the material by previous processing. This process can also contribute to a condition of curvature. The end result of the curvature of the lamination components is that additional voids in the magnetic core exist, reducing the performance and efficiency of the transformer.

The negative effects of the stacking factor associated with the accumulation of burrs is avoided in the present invention by employing a compaction process wherein the assembled transformer is placed in tooling designed for the purpose of applying a force parallel to the stack height sufficient to cause raised burr arrises to be flattened down to the rolled plane of the lamination surface. Any burr arris on the exterior of the core assembly is deformed directly by the tool surface, while those burr arrises within the core are deformed by the rolled surfaces of the lamination with which they are in contact. The fact that the laminations are usually annealed to a fully soft state after stamping contributes to the effectiveness of this process.

In cases where there is a relatively significant void due to the stacking factor attributable to the burr arris as a result of a large number of layers or relatively high burr arris, the lamination compaction factor can be performed in machinery dedicated to this purpose after which additional lamination can be assembled into the volume vacated by the burr arrises. In cases where there is so little volume occupied by the burr arrises as a result of a low number of laminations with very low burr arrises that no additional laminations could be added, the compaction process can be performed immediately prior to injection of the encapsulant in the plastic molding process.

With the burr arrises deformed from their position above the rolled plane of the lamination, additional lamination can be assembled to eliminate the stacking factor component due to out of flat condition of the lamination. This is easily overcome as the addition of the last laminations wedge their way into the assembly, with friction due to the compression attributable to the burr arrises eliminated. Thus, the available volume within the coil assembly is much more fully occupied by the magnetic core material intended to fill this space.

FIG. 2B depicts the compaction process schematically by force vectors 50, 51, 60 and 61. In practice a fixture which conforms to the coil assembly shape, including the bobbin 10, windings 30, 31 and terminals 27, will be used to compress the core lamination to compact the core 14 and to permit the selective assembly of more core material into the aperture 8 than would be possible without compaction.

A further securing of the lamination against any movement or vibrations occurs as a result of the encapsulant conforming intimately to the irregular surface formed by the bobbin assembly as a result of the high pressure employed in the open-mold plastic molding process used to partially encapsulate the transformer (discussed hereafter).

The advantage of the above compaction process is that with higher density of the laminated core, a smaller and also more efficient core can be employed for any given transformer design. The smaller core and more efficient core result in a smaller circumference for each turn of wire yielding lower cost and lower coil resistance for a given wire size. Less coil resistance further improves the efficiency of the transformer and also contributes additionally to lower costs.

Alternatively, it may be desirable to forgo some or all of the benefits of the compaction process in order to use the compressibility of the core to other advantages. In particular, the compressibility of the core may be used as a means of securely clamping the transformer in position during the encapsulation process. Since all of the burr edges which result in the "stacking factor" phenomenon are located in the interleaving zone outside the core of the transformer coil bobbin, and because of the extremely high strength of the coil assembly, the edges of the assembled core plates tend to fan out as they exit the coil. The farther the plates are from the coil, the farther the bobbin tabs 17 and 18 (which help retain the plates) are from the bobbin flange which is the source of their support. The end result is that the bobbin tabs are deflected backward, away from the assembled core plates.

In an alternate embodiment depicted in FIGS. 8A–8E, a bobbin 62 employs extended tabs 65 and 66 which transmit a compressive force to the core assembly from fully closing mold halves used in forming a fully encapsulated transformer or power supply. Bobbin 62 also has extended flange core plate retention tabs 77 protruding from extended flange areas 79. Two major benefits accrue from the use of tabs 65 and 66. There are the thermal and magnetic benefits as discussed previously, as well as the fact that the indirect compression of the core material results in a large force which contributes to immobilize the assembled transformer within the closed mold. This immobilization is necessary to prevent movement of the transformer as it experiences the forces resulting from the rapid injection of the viscous encapsulant into the mold.

In order to gain sufficient clamping force, the bobbin tabs are designed inordinately large. The surface of the tabs 65 and 66 which contact the mold are not encapsulated and thus need to be made of appropriate insulating thermoplastic or thermosetting material, which can be identical or similar material to the encapsulant (discussed hereafter). All joints between the encapsulant and the bobbin are keyed, providing secure joints between encapsulant and bobbin.

Figure 8A:
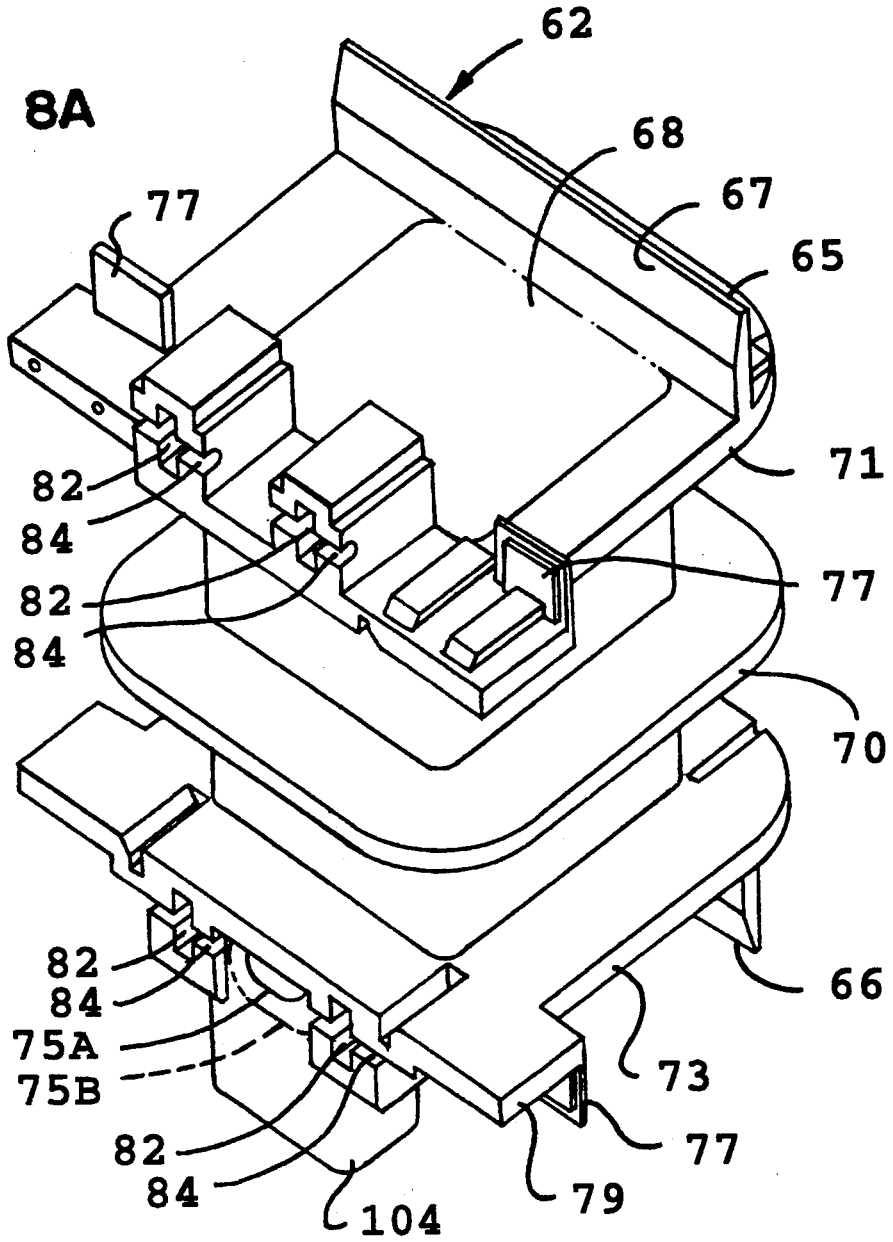
FIGS. 8A–8E various views of an alternate bobbin of the invention useful in making fully encapsulated transformers or power supplies.
Figure 8B:
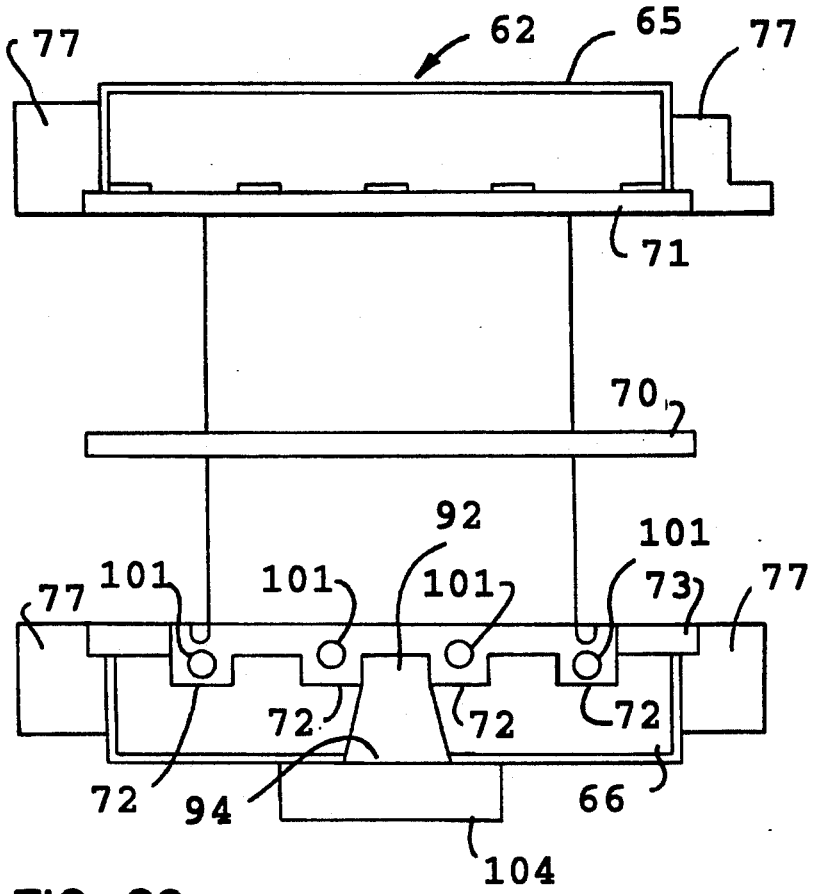
Figure 8C:
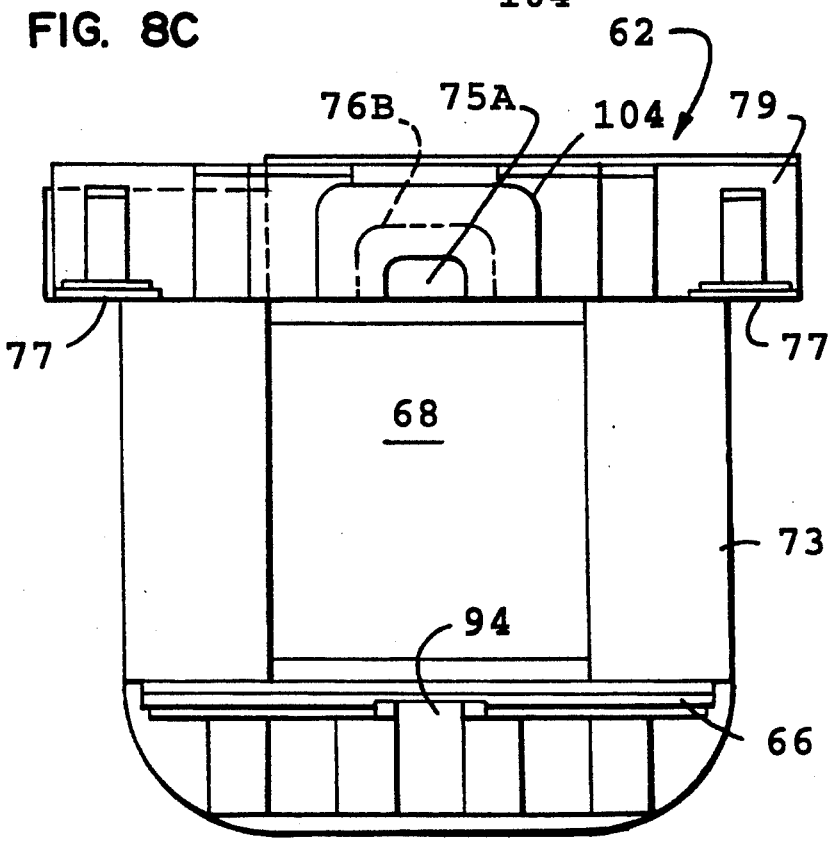
Figure 8D:
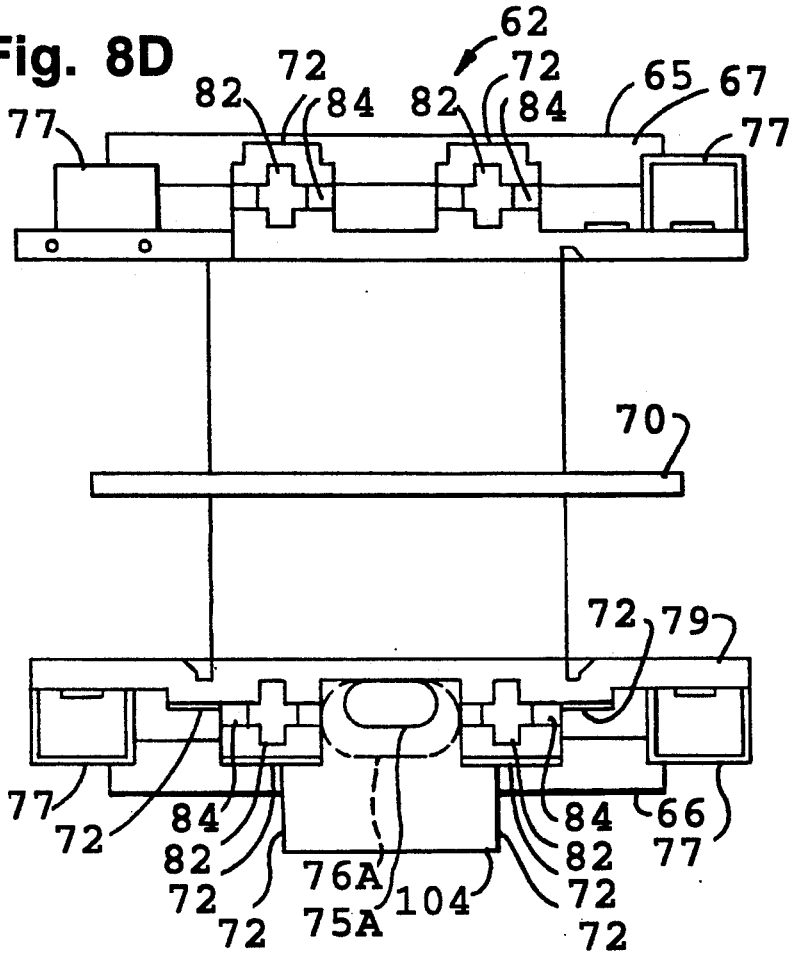
Figure 8E:
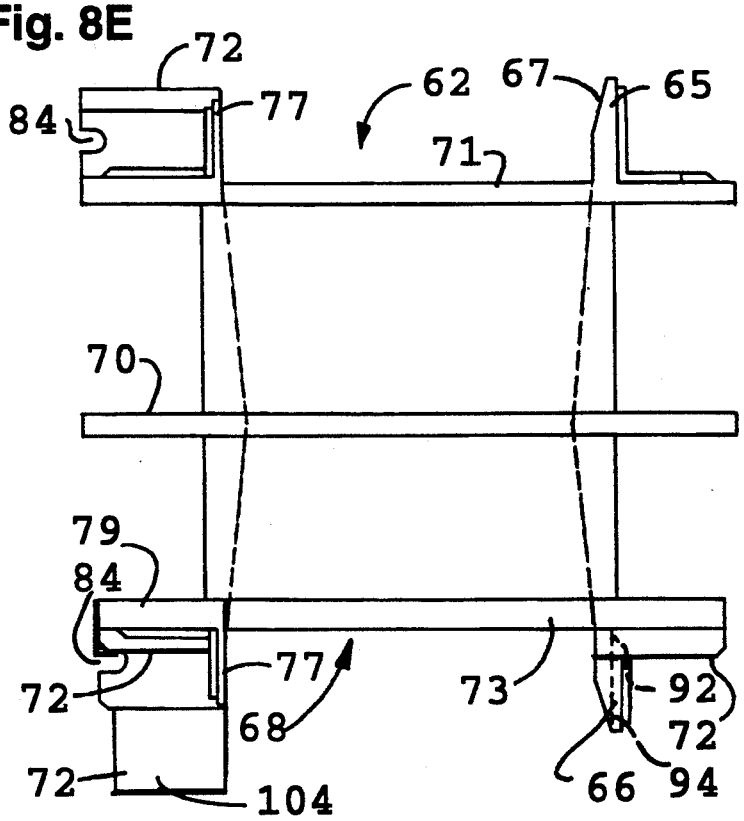

The central aperture 68 of bobbin 62 is tapered inward from both ends to a common size approximately in the center of the aperture, forming an hourglass-like shape (see FIG. 8E). It is preferred that the minimum aperture occur centered under the center of the bobbin center flange 70 so that the naturally occurring sink resulting from the joint of the center flange 70 to the bobbin core wall will tend to withdraw any mismatch of the aperture core halves. In this way, loading of the core plates through the aperture 68 will not be hindered by a small mismatch of the intersection of the split aperture core halves. It is also important to note that the minimum aperture occurs approximately in the center of the coil assembly, and that the assembly is relatively very well able to resist expansion from within as a result of the many turns of magnet wire wound under the highest practical tension (about 85% of the tensile strength of the wire) around the core aperture.

Thus, as the core plates are loaded through the aperture, it is the minimum height of the aperture at it's approximate center which will restrict the additional plates as the aperture becomes full. Even though the burr arrises of the center leg of the core plates theoretically could all lie within the rollover void of the plate below, thus presenting no compressive possibility as a result of their component of "stacking factor", in practice the other components of stacking factor as well as the occurrence of burr arrises not perfectly fitting within the rollover void result in a useful level of compression such that the core plates can be positively retained against loss or even unwanted movement during mold processing.

Having assembled the core plates until the level of compression experienced prevents the assembly of another plate, it will be noted that the "fanning factor" actually emanates from the approximate center of the aperture, the point of minimum height of the aperture. The "fanning factor" is defined as the difference between the height of the assembled core as it exits the aperture and the height of the core at its outside extreme. Thus, within the aperture, the fanning is limited to the taper or draft applied to the aperture. As the core plates exit the aperture, the fanning level is determined by the number and size of burrs existing within the interleaving zone, and on the ability of the compression tabs 65 and 66 to resist the force resulting from the "stacking factor".

The end result is that the level of compression capable is at least equal to the sum of the aperture wall taper or draft plus the fanning factor. By limiting the amount of compression to the sum of the aperture wall taper plus the fanning factor it is assured that the mold cores applying the compressive force to the bobbin compression tabs 65 and 66 never compress the core/tab total height below true net height. If this were to happen, both the tabs and the core material would be damaged as a result of the full clamping force of the molding press being applied to this relatively small area instead of the far greater area comprised by the surfaces of the mold halves in their closure zone.

The total net thickness of the core plate assembly can vary by the thickness of the individual core plates. The major benefit of the present invention is that this substantial variation in the net thickness of the core can be accommodated by static mold components, as opposed to active components such as spring loaded core pins, hydraulically actuated core pins, cam actuated slides or the like.

A transformer is not in any way a rigid object and must be protected from the injection molding process since there are several areas of vulnerability. There is little to physically hold the core assembly together outside the mold other than friction between the core plates themselves as well as with the bobbin tabs. A further weakness exists with the interleaved core plate assembly.

When extended flange core plate retention tabs are used, the tabs must of necessity also provide an inclined surface on both inner and outer edges of the tab. The rationale for the inclined surface on the outer edge of the retaining tabs is apparent as this surface guides the core plate legs into the aperture from the outside, but if similar inclination is not provided in the inner edge, a surface which is really the back side of the bobbin flange, the outer legs of the "E" plate will hit the perpendicular back surface of the bobbin flange. Two undesirable conditions may result.

First, since interleaving machines always operate more effectively with the core plates loaded with the burr arris down, it will be this arris which will be directed toward the bobbin aperture wall. If the leg of the core plate is able to slide under the extended flange, the sharp burr arris will shave material from the surface of the retaining tab. As the opposing "I" piece is installed to meet the "E" piece, the shaved material will be compacted between the core plates producing a magnetic gap and artificially increasing the physical size of that set of core plates. Both conditions are highly undesirable. The second undesirable condition is that one or both of the outer legs will not slide under the flange and will buckle, resulting in hand rework to salvage the transformer.

Thus, problems in mechanized core plate assembly will result from use of extended flange core plate retention tabs. However, in a fully encapsulated power supply design, encapsulation problems can also result if extended core plate retaining tabs are not used. In the fully assembled transformer ready for encapsulation, little retention or support is provided if extended tabs are not used. The "I" pieces are by definition not supported in any way over their outer 1/6 length. The outer legs of the "E" pieces will be found to be totally unsupported or retained from the end of the leg back to the inside of the "E", a length of (3) times the leg width. Since the core plate material has been annealed to achieve the utmost in magnetic "softness", a condition which also provides for similar physical softness, they are readily bent. The velocity and viscosity of the encapsulant combine to empower the encapsulant fully capable of providing the required bending force. Properly designed core plate retention tabs can provide the necessary support to prevent deformation of the core plates by covering the joint between "E" and "I" core pieces.

The apparent contradiction is that extended flange core plate retention tabs cannot be used on the loading side of the aperture and that unsupported "E" and "I" piece joints are subject to destruction in the encapsulation process. The solution provided by the present invention is that the extended flange core plate retention tabs 77 be provided only on the side of the aperture opposed to the loading side. The loading side employs a loading ramp 67, on extended tabs 65 and 66, but only inboard of the outer legs of the "E" pieces. Then, to prevent damage to the exposed "E" and "I" piece joints on the loading side of the aperture, the gating of the mold and internal flow passages is directed such that the viscous flow of the encapsulant is toward the opposed side. Thus, the forces applied by the encapsulant will be employed in clamping the unsupported loading side core plates to the balance of the core, while on the side opposite, the extended flange core plate retention tabs 77 will resist the force which would otherwise tend to bend the core plates away from the stack.

The bobbin 62 also employs encapsulation mold locating surfaces 72 to accurately center the assembled transformer within the encapsulation mold. The locating surfaces 72 of the bobbin 62 are designed to be locating features in the encapsulation mold and these features must of necessity fill their traditional functions in the coil bobbin design, but also must provide full insulation to the exterior of the power supply from the conductive materials within, whether live or dead surfaces. The locating surfaces 72 must also provide sufficient strength to serve their purpose during the injection process.

The locating surfaces 72 provide accurate placement of the transformer within the encapsulant without the necessity of mold core pins contacting the core plate assembly. The use of the locating surfaces 72 in the bobbin 62 for positive location in the encapsulation mold eliminates the defects of prior encapsulating processes which use core pins which can be static or active. If the core pins are static, employing them against the surface or edge of the core assembly will result in an exposed conductive surface to the user. If the core pins are active, then they must be pulled in the last moments of the injection process in the intention that the void caused by their retraction will be filled as the last material is injected into the encapsulation mold. However, this process is inferior in several areas. First, once the core pins are even partially retracted, the transformer becomes free floating in the still molten encapsulant. Since, of necessity, the core pins are widely dispersed within the mold and also of necessity in opposition to each other, a high percentage of the plastic within the mold must then still be molten such that molten plastic is in the immediate area above the surface of the core pin. Since the plastic will be injected into the mold in generally a single location, the force of the continuing injection after retraction of the core pins will be applied to the free floating transformer with the effect of moving it within the fixed volume defined by the encapsulation mold. The same level of viscosity which will permit the filling of the void caused by retraction of the core pin will also permit movement of the transformer. This movement can consist of rotation, lateral displacement, or a combination of the two. It is important to note that the core pins are pulled during or before the highest injection pressure is experienced in the molding cycle, the mold packing process.

Use of the locating surfaces 72 in the present invention for positive location in the encapsulation mold eliminates the above defects. The particular features selected for use as the locating surfaces 72 are employed at each exterior flange area 71–73 of the bobbin 62 for positive location in both the x and the y axis as indicated in FIGS. 8A–8E. These features also fulfill the function of the bobbin flange support ribs, supporting the flange against breakage during encapsulation.

The bobbin 62 also has an output/input cord protection feature useful in making encapsulated power supplies. Bobbin 62 employs a complete four sided primary cord passage 75A (see FIG. 8D) in the plain perpendicular to the core plates, and employs three sides of a secondary cord passage 76A (see FIG. 8C) for an output or input cord in the plane parallel to the core plates located in bobbin appendage 104. The cord passages may be of varying sizes as indicated in phantom views 75B and 76B to accommodate indoor or outdoor cords. Outdoor cords have thicker insulation than indoor cords so the wider passages indicated in phantom view would be for outdoor cords. The words "primary" and "secondary" in this application refer to first and second cord passages, and have no relation to whether the cord serves the primary or secondary winding of the transformer.

Polyvinyl chloride (PVC) is a common insulating material for electric cords and lead wires. PVC, as well as most other wire and cord insulations, has a relatively low melting point, hundreds of degrees below that of the preferred encapsulant materials of the invention. Since it is desired to have the cord encapsulated within the power supply assembly, the PVC insulation must be protected from the temperature and flow-force of the injected encapsulant in order to prevent removal of the insulation, its thermal degradation, and unwanted deposition of the resultant product elsewhere within the encapsulated power supply. The primary and secondary cord passages 75 and 76 provide such a benefit.

Like the transformer assembly, that part of the electric cord or lead wire which is within the encapsulation mold must be immobilized to prevent exposure of an electrically live surface. Electric cords and the like are more difficult to restrain because of their flexibility, and the difficultly in attaching them to a rigid surface to prevent the unwanted movement. The present invention uses the flexibility of the cord insulation and the fanning factor to positively locate and restrain the cord during the injection process, as well as to provide the desired protection.

At assembly of the cord (not shown) to the coil assembly, the cord is fed through the 4-sided primary passage 75A perpendicular to the core aperture. This enclosure provides clearance for assembly ease. After the cord is assembled, the coil assembly is loaded with core plates. The core plates are loaded by machine, from the aperture surface opposed to the open side of the 3-sided secondary cord passage 76A employed in bobbin 62. Thus, as the plates are installed, the growing stack of plates rises from the bottom of the aperture 68 to the top, where the open 4th side of the secondary cord passage 76A is located. The secondary cord passage 76A is designed for an interference fit with the cord, such that the flexible cord insulation will be compressed within the cord enclosure as the first-installed core plate is driven to the top surface of the bobbin by the installation of the last core plate.

If the cord is held under tension either by fixturing or by the interleaving machine operator, there will be no slack cord on the inside end of the primary cord passage 75A, and thus no material subject to movement as the mold is filled. As a result of the forceful nature of the insertion of the last core plate, as well as the relatively high level of compression of the cord into the secondary cord passage 76A, and also as a result of the fanning factor, the secondary cord passage 76A will be deflected away from its parallel orientation with the aperture. Further, there may not be contact between the two parallel sides of the secondary cord passage and the top core plate as a further result of such deflection. In order to correct these conditions, assuring maximum gripping and protection of the cord, the encapsulation mold employs a bridge core. The purpose of the bridge core is to allow the bobbin compression tabs to compress the core assembly back into a parallel condition with the aperture, using this force in opposition to the compression tabs to fully compress the cord into the secondary cord passage 76A and to return the secondary cord passage 76A to a parallel condition with the aperture.

Further, perpendicularity of the two cord passages 75A and 76A to each other, as well as the significant level of clamping force applied between the core plates and the secondary passage provides a valuable strain relief feature for the cord, and may be the only strain relief required for the cord.

Figure 9A:
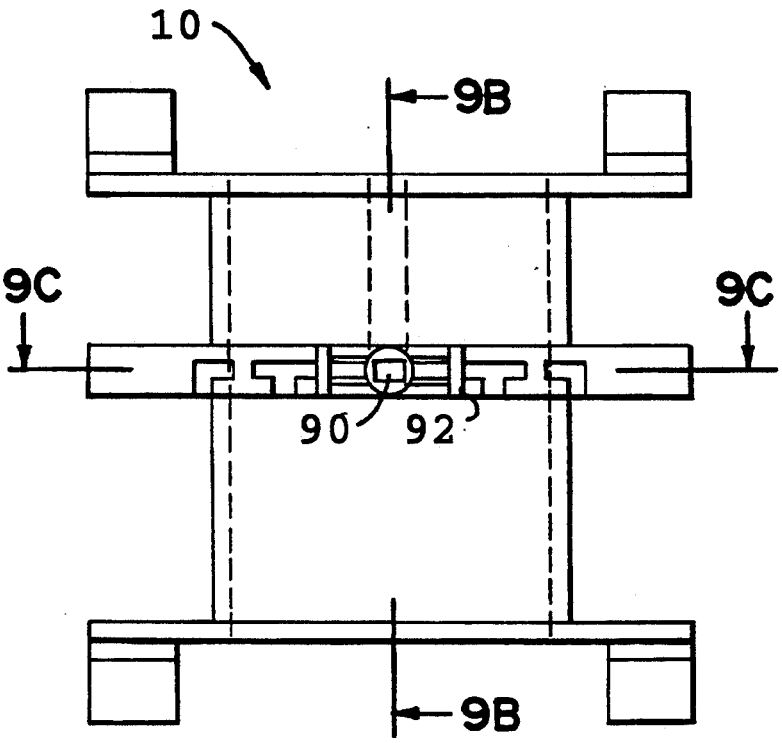
FIGS. 9A–9C are various views of a bobbin having a ground wire passage.
Figure 9B:
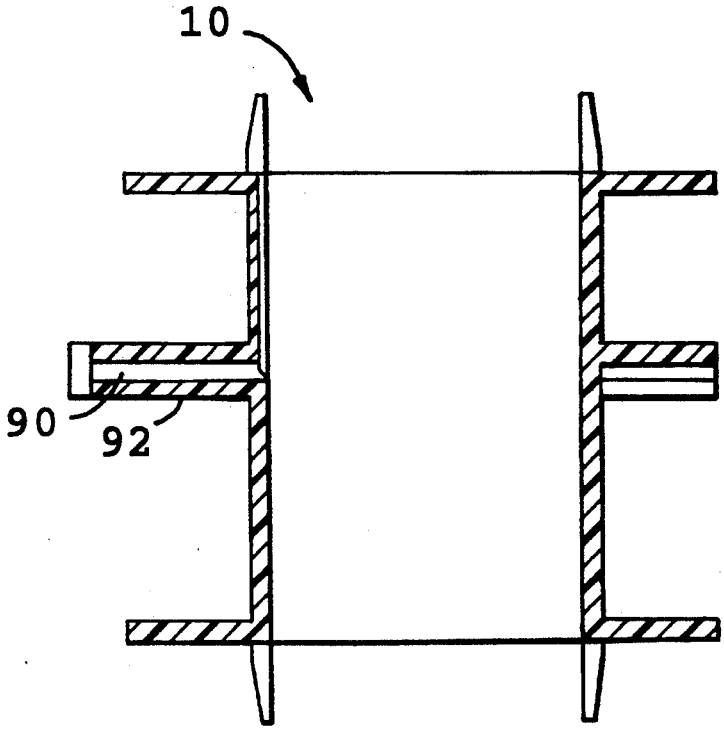
Figure 9C:
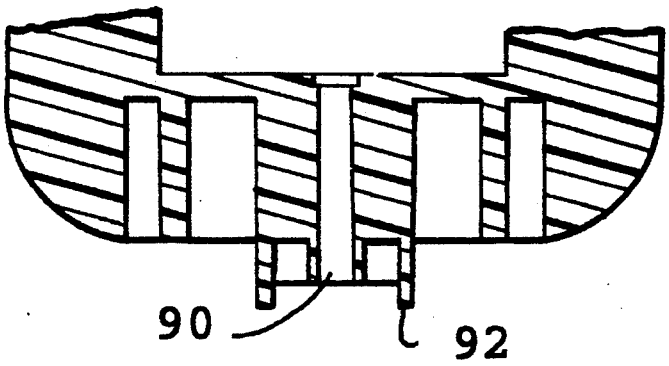

Referring to FIGS. 9A–9C, a ground wire passage 90 may be provided in bobbin 10 or 62 (not shown) on any of the flanges to ground the magnetic core. Electrical grounding of the magnetic core is provided through an insulated or uninsulated ground wire clamped between the core and the interior bobbin wall, and contained within passage 90 in the bobbin wall or within the magnetic core.

For transformers with no other core grounding method, and for transformers equipped with a ½" pipe nipple mounting feature and lead wires, a ground wire is provided permitting grounded installation in plastic boxes, panels, or in or on other non-conductive surfaces.

In many applications it is desirable to mount the transformer directly through a ⅞" knockout in an electorial box or other enclosure. For mounting, transformers employ a ½" pipe thread nipple integral to the transformer, or other device intended to securely mount the transformer. Historically, panels and boxes were constructed of electrically conductive materials and were grounded, and the transformer was also grounded by contact of the nipple or other device. Today, plastic, non-conductive panels and boxes have replaced most of these devices. In order to achieve an electrical ground, the ground wire must enter the box or panel through the nipple or other such attaching feature.

In the present invention, grounding is achieved by providing a passage 90 molded within a flange of the bobbin for the conductor of the ground wire to access the magnetic core of the transformer which is the only exposed conductive component of the transformer. As the conductor enters the volume dedicated to the core, it is bent so as to be parallel to the installation direction of the core laminations, and the conductor is contained within a groove 91 molded for this purpose in the bobbin wall or stamped into the lamination(s) immediately surrounding the conductor. The design of the volume dedicated to containment of the conductor is such that some level of compression is achieved assuring proper electrical contact between the conductor and the core. Location of the ground passage is such that the ground wire and all intended conductors can be routed through the mounting nipple 92.

Figure 10A:
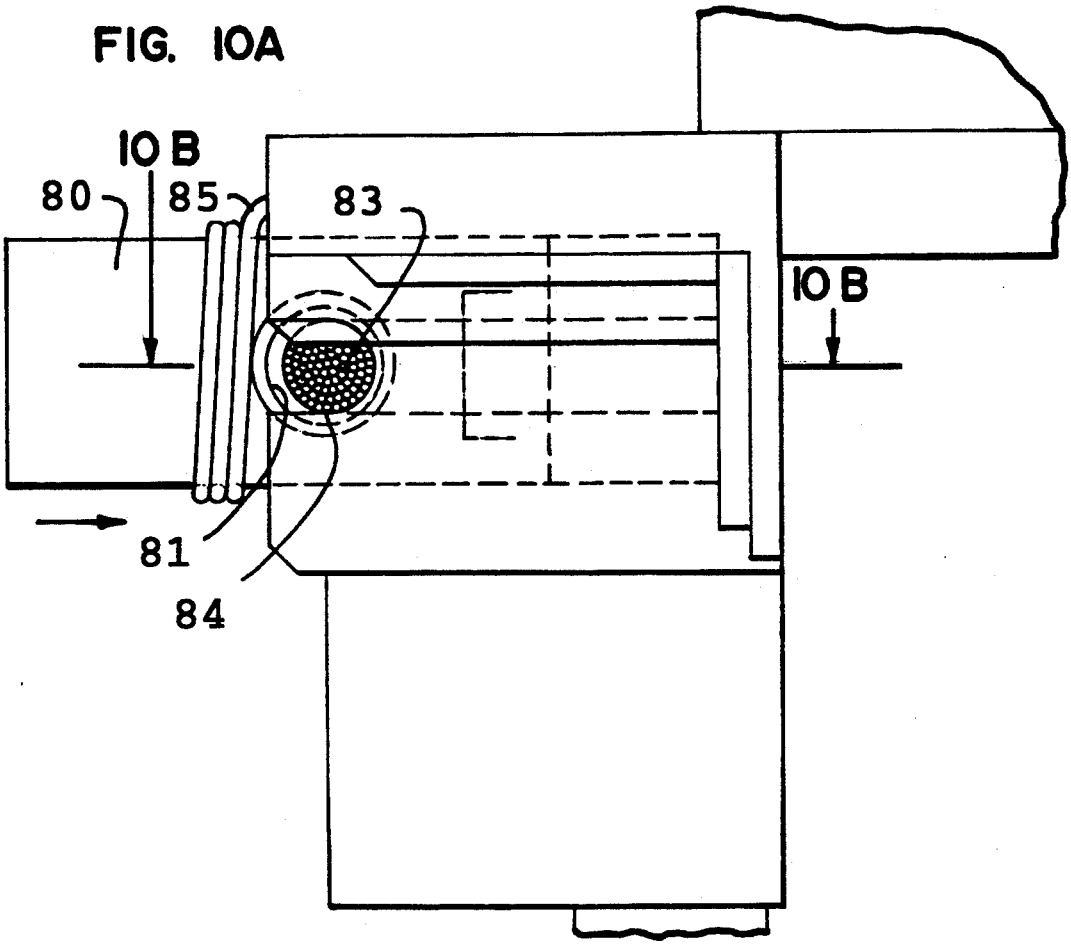
FIGS. 10A and 10B are views of a minimum height terminal of the invention electrically connecting a lead wire and magnet wire.
Figure 10B:
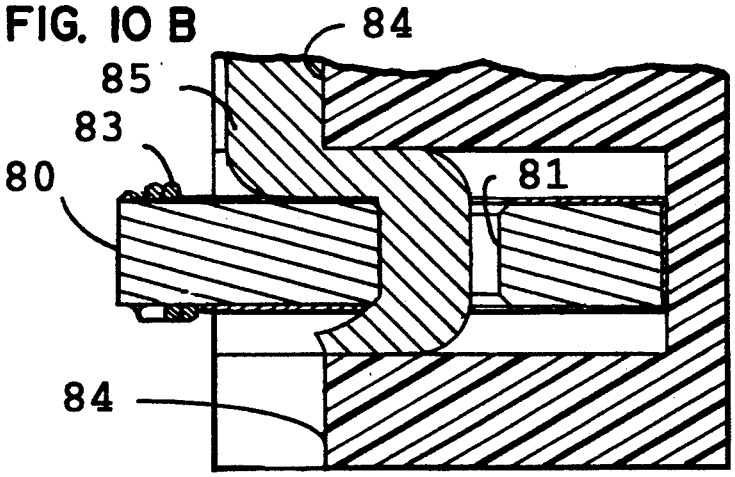

Referring to FIG. 10, a minimum height terminal 80 is depicted which provides for strain relief and common electrical connection between magnet wire and lead wire or cord. Electrical connection is achieved in the assembly process without intervening traditional processing such as soldering, welding, or fusing. This aspect of the invention drastically reduces the costs associated with making electrical connections between lead wires and magnet wires which can be substantial. Furthermore, the height of the terminal-magnet wire-lead wire assembly is minimized so that the encapsulant thickness can also be minimized.

The 180° fold-through-terminal method has been widely used as a mechanical means of achieving both a good electrical connection between a terminal and a conductor, and as a means of achieving a high degree of strain relief. As applied to encapsulated transformers employing lead wires or cord, this method has the disadvantage in that winding a coil bobbin with any lead wire attached is prohibited except on a fly-winding process machine which generally are not capable of terminating magnet wires to terminal pins. Thus, such connection must be made after the windings are produced. This requires a separate set of terminals for the winding, as well as an interconnection between the magnet wire and lead wire terminals. For economy, this duplication of terminals is undesirable. The present invention employs a common-use terminal design and process for its use.

In order for a typical CNC (Computer and Numerical Control winding machine to be able to automatically terminate magnet wire to a terminal, the terminal must be sufficiently rigid in its own right to resist the force associated with terminal wrapping, plus the coil bobbin in which the terminal is installed must be sufficiently strong to support the terminal against the wrapping forces. The present invention employs a terminal 80 and terminal receiving aperture 82 which are massively rugged and of close tolerance manufacture such that the terminal 80 need only be pressed into its receiving aperture 82 about 60% of its length in order to achieve sufficient support for terminal wrapping. At such insertion depth, the lead wire receiving hole 81 aligns with a groove 84 molded as a feature in the coil bobbin 62, providing a means for the insertion of the lead wire through the terminal hole 81 below the plane of the surface of the coil bobbin 62.

With the terminal 80 only partially inserted, the coil winding operation is performed. Anchoring features of the terminal 80 and receiving aperture 82 provide for the secure retention of the terminal during the winding process. As part of the CNC coil winding program, the winding machine wraps the magnet wire 83 around the terminals 80. This wrapping occurs directly above the outer plane of the terminal receiving aperture 82, such that the first wrap of magnet wire crosses the top of the groove 84 intended to receive the lead wire.

After the coil winding process is completed, the stripped end of a lead wire 85 is inserted through the terminal receiving hole, guided by the groove and the terminal wrap overhead. With the lead wire inserted through the receiving hole, the balance of the terminal insertion is performed, folding the lead wire 180° and securely making the intended electrical connection and strain relief. During the balance of the insertion, the wraps of magnet wire are prevented from downward movement by the outer plain of the coil bobbin 62. Thus, the terminal 80 slides through the magnet wire wraps installed by the CNC coil winding machine.

The friction applied to the film insulation of the magnet wire by the terminal is intended to remove the insulation by abrasion. For thin insulation coatings, the striations of the land area, which are perpendicular to the direction of movement, and the natural roughness of the breakout area of the terminal will be sufficient to achieve sound electrical connection between the terminal and the magnet wire. For thickener or tougher insulation films, the terminal edges can be provided with intentionally roughened edges such as by designing serrations or other such shallow sharp edges for the purpose of removing the insulation.

Thus, with a single stroke of a press, electrical connection is made between the magnet wire and the lead wire, as well as providing strain relief for the magnet wire. Furthermore, the joint is no higher than the assembly of the magnet wire to the terminal.

III Transformer and Power Supply Molding Process

Figure 6A:
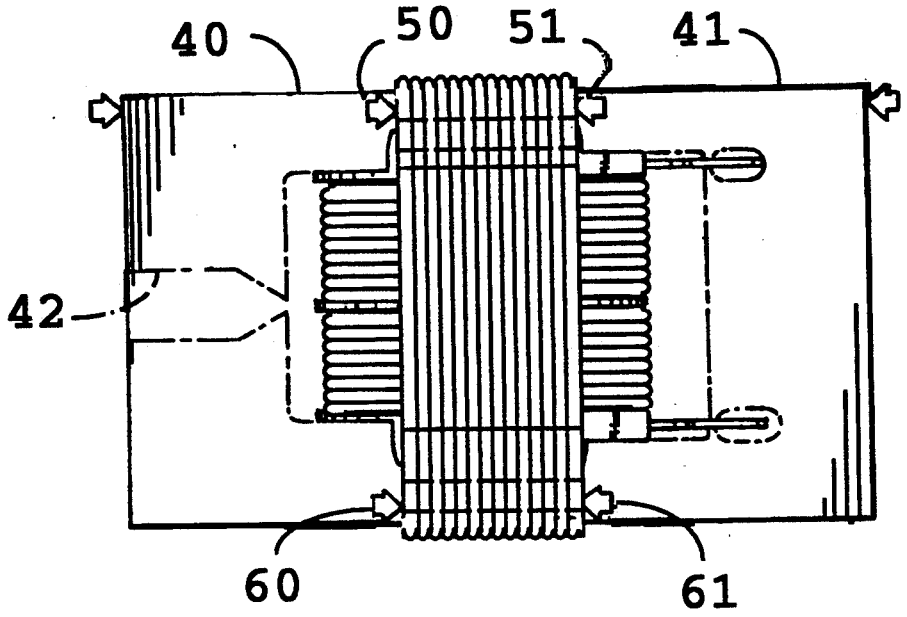
FIG. 6 is a schematic side elevation view of a two piece mold having a transformer core positioned for the molding operation.
FIG. 6B is a schematic top view of the two piece mold having a transformer core positioned for the molding operation.
Figure 6B:
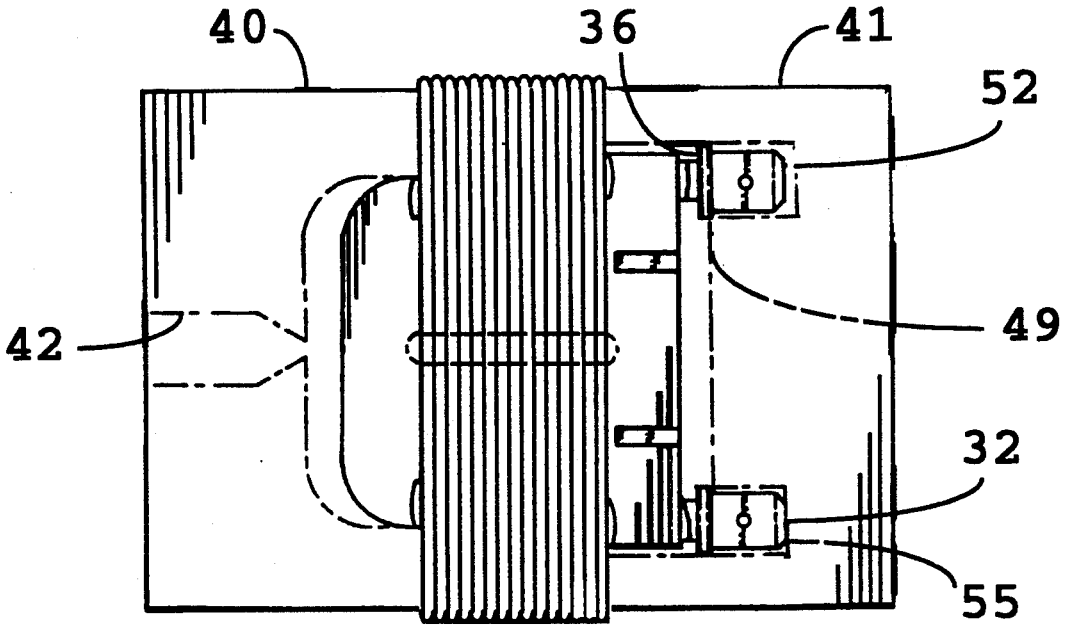

The partial encapsulation process is preferably accomplished by injection molding as depicted in connection with FIG. 6A and 6B. This molding process uses the transformer core as a portion of the mold. The mold faces apply force 50,51,60, and 61 to compress the core during the molding process. This compaction during molding technique serves to further reduce the air gaps associated with the interleaved core laminations and improves the magnetic performance of the finished transformer. The use of the transformer core as a mold element also permits unusually low injection pressures. The small gaps resulting from the non-perpendicular breakout surfaces permits the escape of air from the mold cavity which permits relatively low injection pressures.

A variety of polymeric resins may be employed as the encapsulating material, including both thermosets and thermoplastics. The thermosets are materials that undergo during the molding cycle further reaction and/or crosslinking in the presence of a reaction promotor which can be a catalyst, crosslinking promotor or a crosslinking initiator. During the polymerization of thermoset resins there are reactive portions of molecules that form crosslinks between long molecules. Therefore, once polymerized or cured, thermosets cannot be softened by heat, since the plastic material has taken an irreversible chemical change. Plastics included in this group are the amino (melamine, and urea) alkyds, allylics, epoxys, phenolics, most polyesters, silicones and urethanes. Typical properties of thermoset products are high thermal stability, resistance to creep and deformation under load, high dimensional stability and rigidity, and hardness.

Thermoplastic materials can be repeatedly softened by elevated heating and hardened by cooling. These materials are all linear, with many being slightly branched polymers. Thermoplastic materials consist of long molecules and each may have side chains or molecular groups not crosslinked. There are two phases of thermoplastics, amorphous and crystalline. In the amorphous phase, the thermoplastic is devoid of crystallinity and has no definite order. Amorphous materials have a randomly ordered molecular structure and behave very similar to a very viscous and elastic liquid. These resins usually require less energy to bring them to forming temperature and to cool than crystalline resins. Amorphous plastics are never as easy flowing as crystalline resins. When cooled they do not reach a totally "non-flowing" solid state. They do therefore have a tendency toward creep or movement with age when a load is applied. Such plastics as the following are useful amorphous resins: acrylonitrile-butadiene-styrene (ABS), styrene, vinyl polymers, acrylic polymers, cellulosics, and polycarbonates.

Crystalline thermoplastic molecules have a natural tendency to line up in a rigid precise highly ordered structure like a chain link fence. This gives them good stiffness, low creep, etc. Unlike amorphous plastics, when crystalline sheets are heated, they remain very stiff until they reach the glass transition temperature (Tg). At the Tg, crystalline plastics soften. Useful crystalline thermoplastic materials include nylon, polyethylene, polypropylene, acetal.

The preferred encapsulant material is polyethylene terephthalate (PET). A preferred PET is the material sold by DuPont, of Delaware under the tradename "Rynite".

In the partial encapsulation process, the thermoplastic or thermosetting material is softened in the barrel of a conventional injection molding machine and is then injected into the mold cavity formed by the mold halves in conjunction with the transformer core. The encapsulating material may be heated to approximately 500° F., and the injection pressure may range from 100 to 3000 psi. Once the mold is filled, the pressure in the melt, or holding pressure, may be increased to approximately 5000 to 10000 psi, with a mold temperature of 210° F. In general, the optimum molding parameters will depend on the particular transformer size under construction and the particular injection molding machinery used for the shot.

The injection molding process completes mechanical and electrical assembly of the transformer and results in an improved transformer exhibiting improved mechanical and thermal performance characteristics. The encapsulant mechanically locks the core section into position and prevents the individual core laminations from moving and causing transformer buzz. The encapsulant protects the wire of the windings from the environment and also operates as an insulator providing electrical isolation between various transformer elements. The encapsulant also provides thermal interconnection between the electrically isolated transformer elements which improves heat dissipation to the environment.

FIG. 6A shows an assembled transformer loaded into the molding cavity of an injection molding mold to produce a partially encapsulated transformer. The mold has a front half 41 and a rear half 40. The core lamination abuts the mold halves and spaces them apart during the molding operation. This effectively makes the transformer assembly a portion of the mold. This molding technique places the core laminations under compaction pressure during the molding process as shown in FIG. 6A by force vectors 50, 51, 60 and 61. The compaction pressure and resulting static friction prevent the injection pressure from springing the core. It appears that the compaction process during the molding shot also reduces air gaps in the laminated core structure which then remain mechanically locked after the encapsulant solidifies.

It is important to seal the mold against leakage or "flashing". The high clamping force between the molding platens forces the mold halves into contact with the annealed iron laminations providing an effective seal which prevents flashing between the core laminations and the parting faces of the mold. Flashing is prevented proximate the electrical termination by the use of specialized structures on the terminals 27. In use these specialized sealing structures perform two functions. First they permit air to escape from the mold ensuring that no bubble is formed in the mold at the electrical terminal. Secondly, the sealing structure prevents leakage from the mold along the contact surface of the connector.

FIGS. 4 and 5 show these sealing structures. Each terminal comprises a tang portion 43, a notched portion 44, and a connection portion 45. After encapsulation the tang and notched portions are substantially completely covered by encapsulant while the connection portion is free of encapsulant. During assembly the tang is inserted into the appropriate slot until the tang flange 46 abuts the unitary bobbin body. During the soldering operation a wrap of the winding wire is placed in the notched portion of the terminal and soldered to the terminal 27, as shown at the soldered joint 47 shown in FIG. 2B.

Two approaches may be taken to prevent expressing the terminal 27 into the mold 41 during a shot. First, the "assembled" transformer may be placed in the mold halves as shown in FIG. 6B, where the connector tip flange 48 abuts a cooperation surface on the mold 41 shown in FIG. 6B as 49. Under the pressure of injection, connector flange 48 prevents terminal 27 from being expressed into the mold 41. A second approach is to have the terminal connection tip 32 bottom out in the mold recess as shown at 55 in FIG. 6B.

In either case, plastic flow is prevented by the sealing ridge 36 which is raised in the terminal material during manufacture. It has been determined that the sealing ridge height must be controlled to a total clearance between the sealing ridge 36 and the mold 41 of approximately 0.001 inch. In general the accumulated tolerances in the coil bobbin assembly prevent direct insertion of the terminals into the mold recesses. Therefore, some flexibility is provided in the terminal bobbin assembly to permit guiding and relocating of the terminals as they are placed into the mold 41.

Since the mold recess is used to relocate the terminals 27, it must be assumed that residual force will remain, which force will generally assure that the total clearance provided between the mold recess and the terminal seal volume represented by sealing ridge 36, will occur on one side of the two axes describing the plane beyond which the encapsulant must not flow. Thus, the practical clearance allowable to allow insertion but still prevent the flow of plastic is only half of what it would be if the terminal were centered in the recess. This varies with the nature of the encapsulant, and is exceeded by the tolerance of the rolled stock from which the terminals 27 are stamped. Therefore, it is preferred to raise a sealing ridge 36 during the stamping process and to then subsequently press the terminals between platens to reduce the ridge height to a well controlled dimension resulting in a well controlled sealing volume. Although any of a variety of metal working processes could be employed to create the sealing ridge it is preferred to raise the ridge during the stamping of the terminal and to employ a subsequent flatting step in the stamping die to produce a controlled ridge height.

Figure 11A:
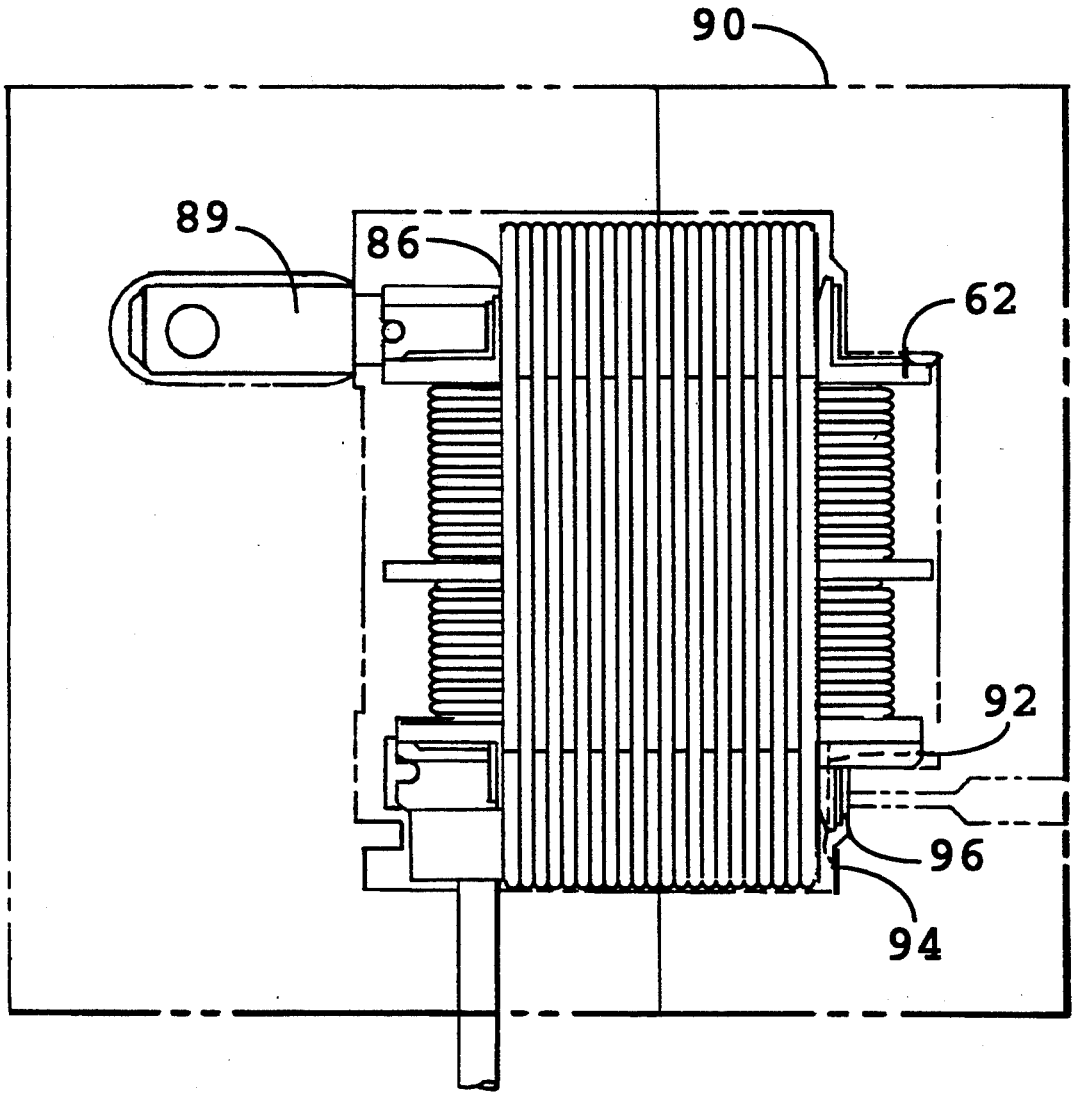
FIG. 11A is a schematic side elevation view of a two piece mold having a wall plug-in power supply positioned within it for the molding operation.
Figure 11B:
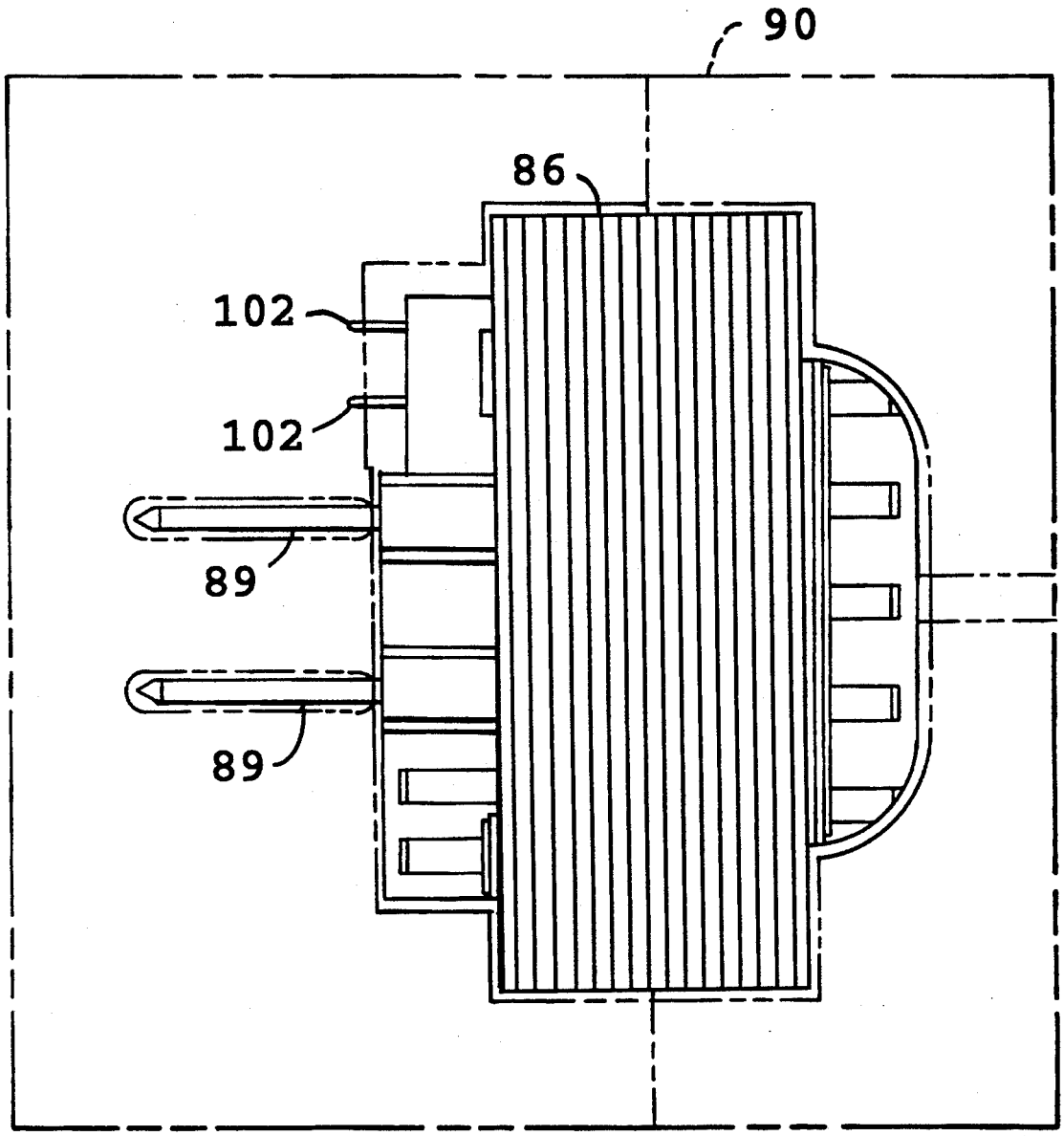
FIG. 11B is a schematic top view of the two piece mold having the wall plug-in power, supply positioned for the molding operation.

A 15 amp 120 volt standard blade 89 with the above described sealing feature can be used in the case where wall plug-in power supplies are made (see FIGS. 11 and 12).

In operation the hot thermoplastic is injected under pressure into the injection port 42. The plastic flows around the bobbin and through windows formed between the bobbin and the windings of the transformer. The high injection pressures force the plastic into conformity with the interior of the core lamination and the windings. This results in good conformity between the plastic and the iron core material and the transformer windings. The intimate contact between the core and the windings results in good heat transfer between these elements. Separation of the core lamination in the completed transformer is prevented by the "sprue rivet" formed by the entry of plastic into the stacked lamination apertures 29. The molding process fills this void effectively, mechanically coupling the core material to the encapsulant.

Prior art transformers of normal efficiency run quite "hot" under load. Typically, the windings operate at 115° C., while the core material operates at a temperature of 85° C. Test transformers of the configuration depicted in FIG. 7 have a substantially more uniform temperature distribution with the windings operating at a temperature of 105° C., and a temperature of 95° C. at the core surface. This important decrease in operation temperature results from improved thermal transfer within the transformer assembly and improved electrical performance resulting from the design characteristics of the transformer. The design features result in the packing of a maximum amount of core material within the bobbin as well as the reduction of the air gaps associated with the lamination assembly.

Referring to FIG. 11, a schematic view of an assembled wall plug-in power supply 86 placed in a full encapsulation mold 87 is depicted. There are substantial differences which exist between the requirements of the full encapsulation process and the partial encapsulation process. One of the major differences is that the partial encapsulation process provides for the very accurate placement of the components desired within the encapsulant. The partial encapsulation process also provides for firm resistance to the forces of injection as the transformer core is solidly clamped between platens by the full clamping force of the molding machine. Neither of these advantages are inherently present in the total encapsulation process.

The preferred thermoplastic polymer of PET ("Rynite", DuPont), has outstanding compressive strength while still retaining a modicum of flexibility. These features are used in connection with the spongy nature of the assembled, interleaved core plates in the full encapsulation process. The fact that the "Rynite" has sufficient resiliency to resist breakage is used to get a firm grip on the transformer core plates indirectly, rather than directly as in the partial encapsulation process. The core components of the mold are used to exert a clamping force against the assembled core plates through the extended bobbin tabs 65 and 66. In order to be able to generate the high levels of clamping necessary, the transformer gripping core components are not parallel to the surface of the bobbin tabs 65 and 66 and the core plates, but rather exhibit a slightly angular surface such as the mirror image of the angle presented by the fanning of the core plates. Thus, the greatest level of force is applied farthest from the bobbin flange so that the high compressive strength of the "Rynite" can be used without applying a large sheer force to the bobbin tabs at their intersection with the bobbin flange where a break might result. Thus, the flexibility and compressive strength of the "Rynite" material is used without risk of structural damage to the bobbin.

As a result of the very high pressures employed in the encapsulation process, all air filled volumes within the mold will be filled with the encapsulant. For relatively exposed surfaces close to the gate, it is likely that significant volumes of molten plastic will flow across the surface in order to reach more distant areas of the mold. The amount of flow actually in contact with the surface is determined by the combination of temperature of the surface and the thermal conductivity of the material comprising the surface. It is this action which has the ability to damage or remove insulating materials of low melting point such as cord insulations. A second, different condition exists where the thoroughfare of the molten plastic is denied even though access of the encapsulant is not denied. If the mass of encapsulant admitted to an entrapped (but vented) volume is small in relation to the thermal mass of the solid volume within, no thermal damage will be possible. If it is desired to gate the encapsulation mold on a particular end of the transformer, the mold design can balance the flows such that a cord (if present) at the other end of the transformer will be the last area of the mold to fill, and will thus not experience the destructive flow of molten thoroughfare.

The combined features of the coil bobbin 62 and the full encapsulation mold 87 merge to provide flow passages and a reception chamber 93 for the arriving encapsulant so that the flow is divided between internal and external needs and the violence associated with high injection velocities through small nozzle orifices is avoided Velocities through injection nozzles can become destructively high because of the need to perform the injection rapidly as a result of the high solidification temperatures of the encapsulant. Velocities are also raised by the desire to absolutely minimize the gate size in encapsulations where the gate is subject to exposure to sight. Further, the difficulty in dealing with the aesthetic removal of any kind of sprue is further compounded by increase in diameter of the sprue. Thus, all factors combine to motivate the use of the smallest passage into the encapsulation mold.

It is also desirable to consider the effects of injection on the windings. If the gate diameter is not relatively large with respect of the volume of encapsulant, displacement of windings is possible during injection, and especially during the mold packing portion of the molding cycle. For this reason also, the effects of encapsulant flow must be considered, especially where the windings are near the gate.

In the total encapsulation process, the flow directed to internal filling of the core must be balanced with the flow directed to external encapsulation such that little, if any net force is experienced which would tend to collapse the core inward or expand it outward. Care must be exercised in protecting the transformer from the violence of the injection process. For example, an encapsulation operation involving (1) cubic inch of material injected into a mold in ½ second through a nozzle diameter of 0.060" would involve stream velocities of as much as 60 feet per second. The high temperature of the encapsulant and the relatively high viscosity combine to provide potential for destruction of internal components if the kinetic energy of the high velocity encapsulant is not safely dissipated.

The present invention provides a reception chamber 93 consisting of three sides formed by bobbin walls and the forth by the encapsulation mold such that the high velocity encapsulant is shot into the chamber with previously arrived encapsulant being the only material hit by the high velocity stream. The coil bobbin walls, which are preferably made of "Rynite", exhibit far too low a thermal conductivity to permit their melting and destruction by the molten flow. The fourth wall provided by the encapsulation mold is impervious of the temperature and viscosity of the flow, but must be thermal controlled so as to prevent unnecessary loss of heat from the arriving encapsulant. Both actual temperature and thermal conductivity of the mold surface are of critical importance. The surface must be hot and thermally non-conductive enough to prevent the excessive cooling of the arriving encapsulant, but it must also provide some cooling effect for the encapsulant after the injection velocity has dropped to near zero so that the mold can be opened and the encapsulated device ejected at the earliest possible time.

Numerous products exist for controlling the temperature level of injection mold components, but less attention has been focused on the thermal conductivity aspect of mold components, with most being various grades of tool steel or more thermally conductive materials such as beryllium copper. In the present invention, the use of less thermally conductive materials for mold components is preferred where maintenance of encapsulant temperature is important. One such preferred material is Ti6A14V, a titanium/aluminum/vanadium alloy with very low thermal conductivity for a metal.

Figure 12A:
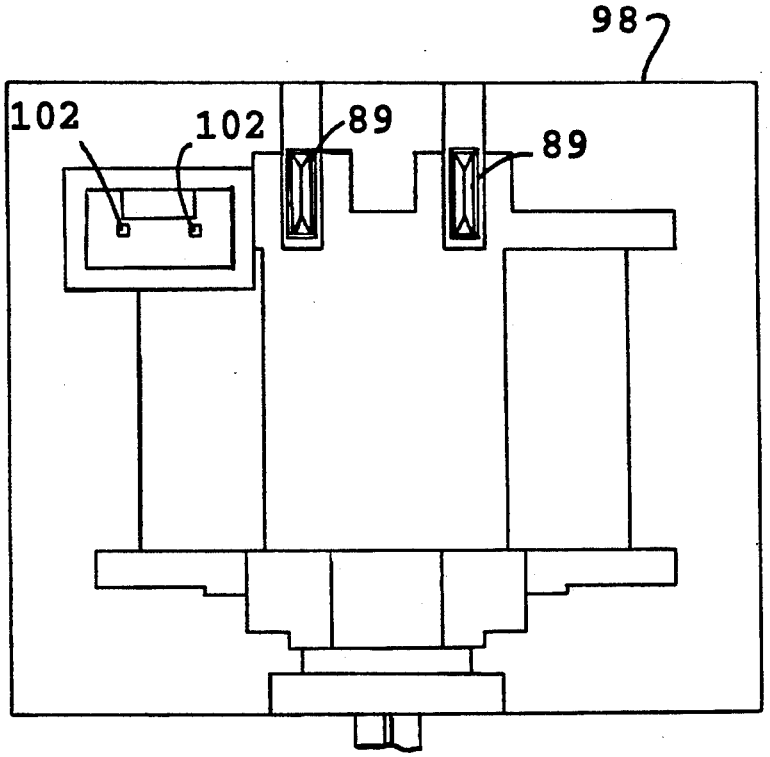
FIGS. 12A and 12B are front and side views of the fully encapsulated all plug-in power supply.
Figure 12B:
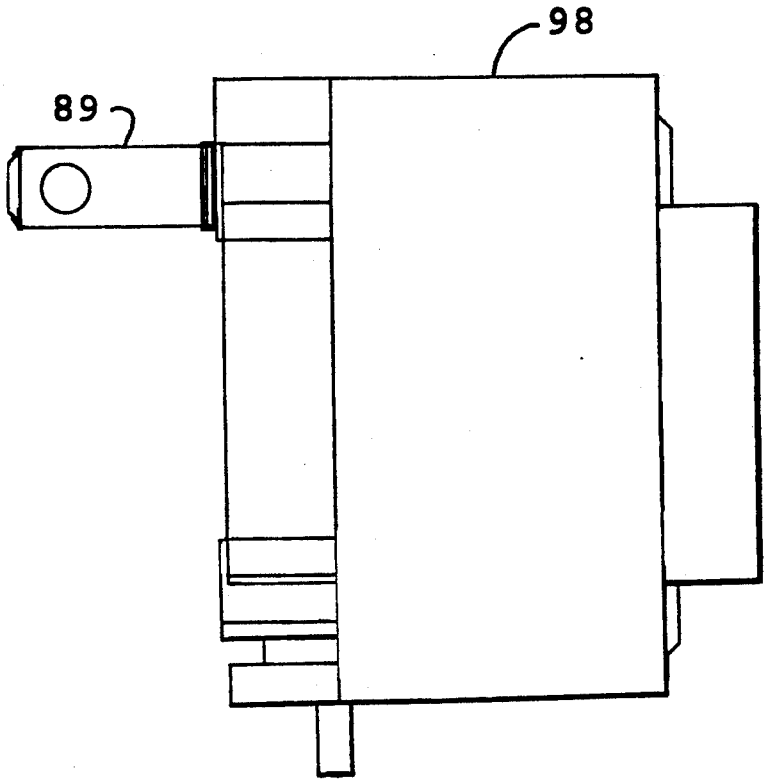
Figure 13A:
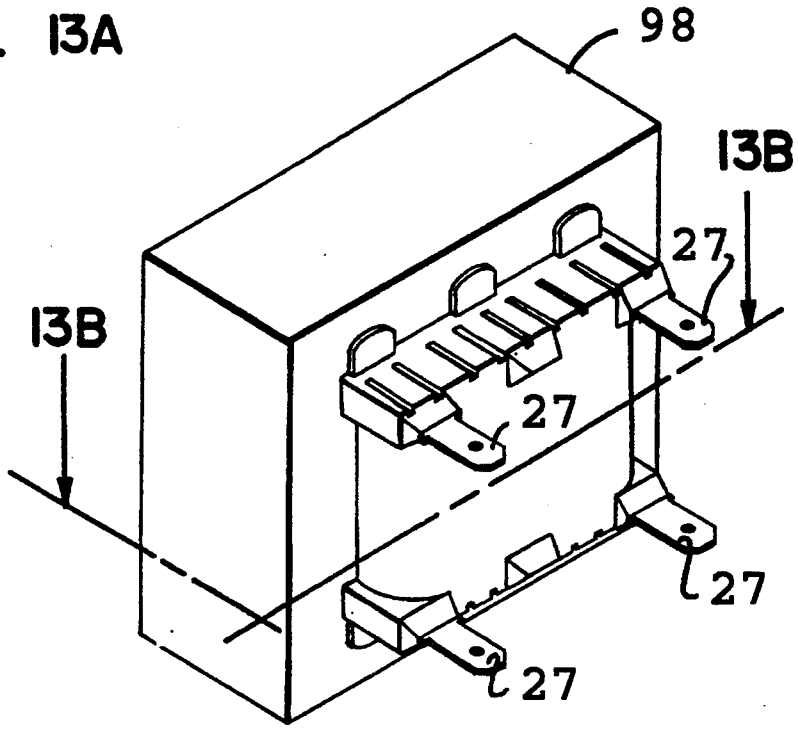
FIG. 13A is a perspective view of a completed fully encapsulated transformer.
Figure 13B:
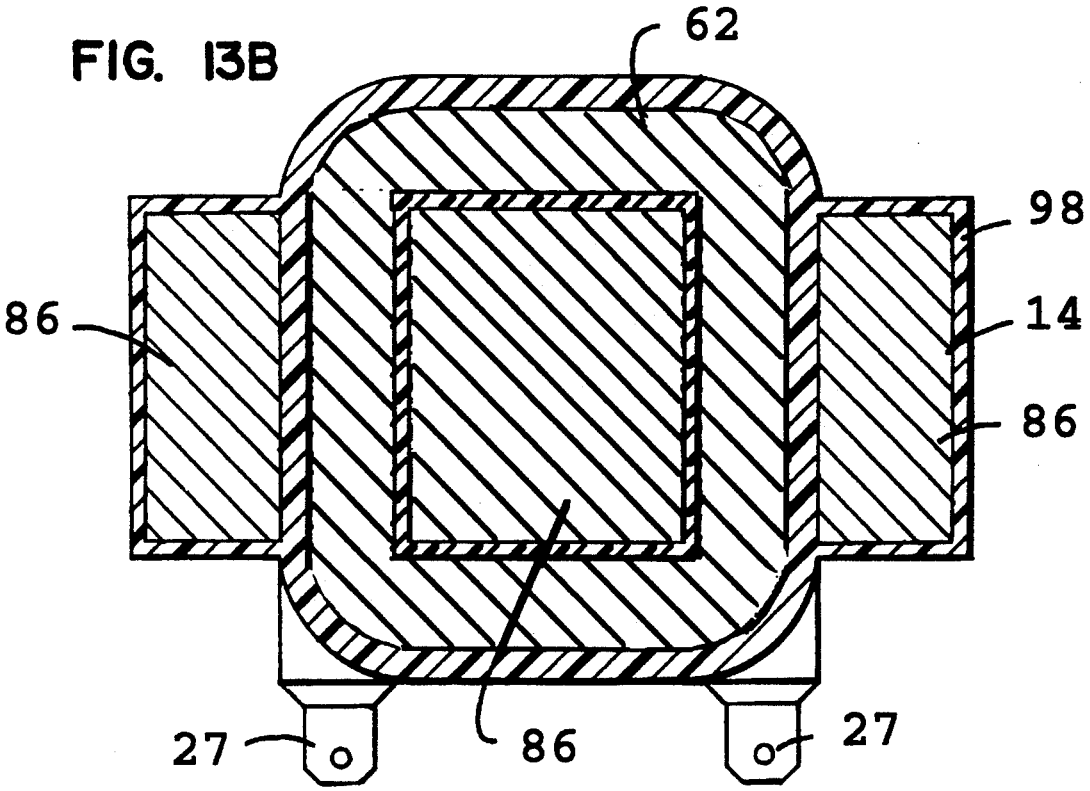
FIG. 13B is a top cross sectional view of the completed fully encapsulated transformer of FIG. 13A.

The encapsulant reception chamber 93 has a bottom exit port 94 which fans the flowing encapsulant out over the core plate assembly 86 and external features of the transformer, and also has a 360° clear gap 96 between the coil bobbin flange and the encapsulation mold surface which contains the gate. In operation, the high velocity encapsulant stream fills reception chamber 93 from entry port 95 and as a result of back pressure emanating form the exit port 94 at the bottom of the chamber, the chamber overflows throughout the 360° gap 96. Thus, the balance between the flows directed over the outside of the transformer through the reception chamber exit port and that directed inside the core assembly of the transformer by overflow through the gap can be controlled. This control is achieved by varying the size of the gap between bobbin flange and mold surface, and by varying the cross sectional area of the reception chamber and the size of the exit port at the bottom of the chamber. FIGS. 12A and 12B depict a fully encapsulated wall plug-in power supply after encapsulation. FIGS. 13A and 13B depict a fully encapsulated power transformer.

During the encapsulation process, the proper temperature of the core assembly will result in a conformal coating of solidified material forming over all exterior surfaces of the core assembly. This coating will occur relatively instantly as the material flows over the relatively conductive core plates. Later, as mold packing begins, the conformal skin will prevent entry of encapsulant into the interface areas between plates such that the packing pressure will result in a hydraulically applied compressive force sufficient to totally compact the core for maximum heat transmission.

In designs intended to be free-standing applications, where UL or other safety authority provides only minimum thermal rise so as to limit risk of burn, thermal balance of all transformer heat production must be considered so that no surface area of the transformer exceed limits. Three sources of heat must be considered, the core, and the primary and secondary windings.

In general, the far more massive core with its much greater surface area for heat dissipation must provide sufficient cooling for the two coils such that the heat conducted to the surface of the encapsulant over the coil assembly does not result in an over temperature condition. Thus, the flow of heat from the coil must be substantially diverted from the front and rear faces of the coil assembly, where it might otherwise be conducted to the exposed encapsulant surface, to the window area of the core where it can be absorbed into the cooler core and brought to the surface over the core for dissipation to ambient air at lower temperature.

If the transformer were viewed from a position axially parallel to the coil aperture, and with the core laminations running from the 3 o'clock to 9 o'clock position, then the desired effect is to have two counter-rotating flows of heat: from the 12 o'clock position to the 3 o'clock and 9 o'clock positions, and from the 6 o'clock position to the 3 o'clock and 9 o'clock positions. Further, it is desired that inter-plate transmission of heat be facilitated within the core such that the thermal gradient experienced across the assembled thickness of the core is minimized.

One of the greatest performance limiting factors in transformer design is elimination of the heat produced within the transformer windings. The transformer windings under consideration here are of either square or rectangular cross section as dictated by the cross section of the stack of core plates which will be assembled within the coil bobbin. The more layers of wire that are wound on the coil form, the more the cross section of the winding departs from the square or rectangular cross section and approaches that of the round or oval cross section. Thus, significant air voids are contained within the winding as a result of subsequent layers of wire not conforming intimately to the layer immediately prior. With the individual wraps of wire not in intimate contact with each other, heat form one layer of wire must be conducted across an air barrier to each succeeding layer in order to be transferred to the exterior of the winding which is the only place from which it can be eliminated in conventional designs. The end result is that heat is inefficiently conducted from the interior windings of the coil to the exterior of the coil. In prior art designs, the heat then finds an insulating layer of air trapped by electrical tape. After being conducted through this thermal barrier, the heat must once again be conducted through an insulating air barrier after which it must then be conducted through a coil cover device into the ambient air.

The effect of this great thermal inefficiency is that winding temperatures rise unnecessarily high. To counteract this high degree of thermal inefficiency, the transformer is of necessity designed to be electrically and magnetically more efficient so as to create a less amount of heat to dissipate. The manufacturer thus pays the higher material costs associated with a highly efficient design only to produce a transformer of poor performance resulting from high winding temperature rises.

The present invention uses the flow characteristics of high temperature, high viscosity, injection molded encapsulant and the high thermal conductivity of copper or aluminum magnet wire, to form a conformal skin over the outer winding surface, without substantially impregnating the winding layers. The conformal skin produced over the winding surface provides a surface for the compression of the windings against the core of the transformer in order to eliminate much of the air trapped within the windings and in order to bring the individual windings into intimate contact with each other, thus dramatically improving thermal conductivity through the coil.

The compression of the core within the coil bobbin and then injecting plastic into any void created by the compression, results in a construction devoid of air thermal barriers and allows substantial heat to be conducted into the much more thermally conductive core from the coil. The molded plastic is used as an electrical insulator and as a thermal conductor since it is in intimate contact with all interior surfaces and does not present any boundary layer to impede thermal conductivity. This facilitates thermal conductivity between the exterior surface of the coil and the interior surfaces of the window formed by the assembly of the laminated core plates.

In the present invention, integral component compartments may also be formed during the encapsulation process. The compartments may be formed within the encapsulant, as well as beyond the volume of the encapsulant for the housing of peripheral or support devices for the transformer or power supply.

While some transformers, consisting of nothing more than two windings, a coil assembly, and a magnetic core are applied directly to their intended use with no other intervening components, many transformers require support devices such as thermal or over current protectors. Peripheral devices such as rectifying bridges and capacitors, relays, and a wide range of other control devices are also applied to permit the power supply to properly perform its intended function.

Since the encapsulation process is performed in an injection molding machine, the ability exists to provide a wide range of features and benefits beyond those which are the primary reason for the encapsulation operation. These features can include mere housings for support devices, or they may actually include provision for some of the components for such peripheral devices.

Although devices used as inserts for molding in prior art processes can be directly included in the encapsulation process, the temperature, pressure, and viscous flow of the encapsulant precludes such inclusion of most passive and all active control devices. While many devices can be shielded from the viscous flow and high temperature of the encapsulation process, they cannot effectively be shielded from the crushing pressure required to properly pack the encapsulation mold. This pressure is on the order of 10,000 psi.

However, the present invention provides for the molding of compartments for such peripheral or support devices within or outside the encapsulant. Special features provide for electrical connection of such devices, after which the cavity may be closed by use of a cover installed by ultrasonic welding or other joining process. The present invention uses a CNC coil winding machine to provide electrical connection between the windings and terminal pins intended to directly serve the devices without the cost of lead wire or the labor for its use. The conductor for such connection is intended to be magnet wire, rather than stranded, insulated lead wire commonly used in prior art designs. Magnet wire costs are in general an order of magnitude lower than the cost of lead wire. Further, use of terminal pins or other such mechanical connection devices for electrical connection eliminates most of the labor associated with lead wire applications where the lead wire must be cut to length, stripped, affixed to the other devices and then electrically connected by soldering, fusing, welding or other process.

It has previously been described how stamped terminal devices can be produced to tolerances which will permit stopping the flow of the encapsulant at the desired location. There are also processes sufficiently accurate for the production of square electrical terminal pins such that they can also be used in a properly designed encapsulation mold for the transferral of electrical power or signal through the surface of the encapsulant. Such processes include die swaging and wire drawing.

The sequence for the application of the present design is as follows. Locating holes 101 for the terminals 102 are incorporated into the bobbin mold design (See FIGS. 8B and 12A). Locations for such holes are not confined to the traditional surfaces associated with the coil bobbin, but rather can be included on any sort of bobbin appendage which will not interfere with the coil winding or core plate assembly processes. In particle, a bobbin or component for another device might be such an appendage.

During the coil winding process, the CNC winding machine is used to connect magnet wire to the terminal pins or other terminals in the desired electrical arrangement. Such electrical connections made with the magnet wire may or may not include direct connection to one of the transformer windings. An electrical connection is then made between the film insulated magnet wire and the terminal pin. This connection may be by welding, soldering, fusing or other process. The desired encapsulation is then performed, with the electrical connection between the magnet wire and terminal contained within the encapsulant, but with the balance of the terminal protruding beyond the surface of the encapsulant.

Figure 14:
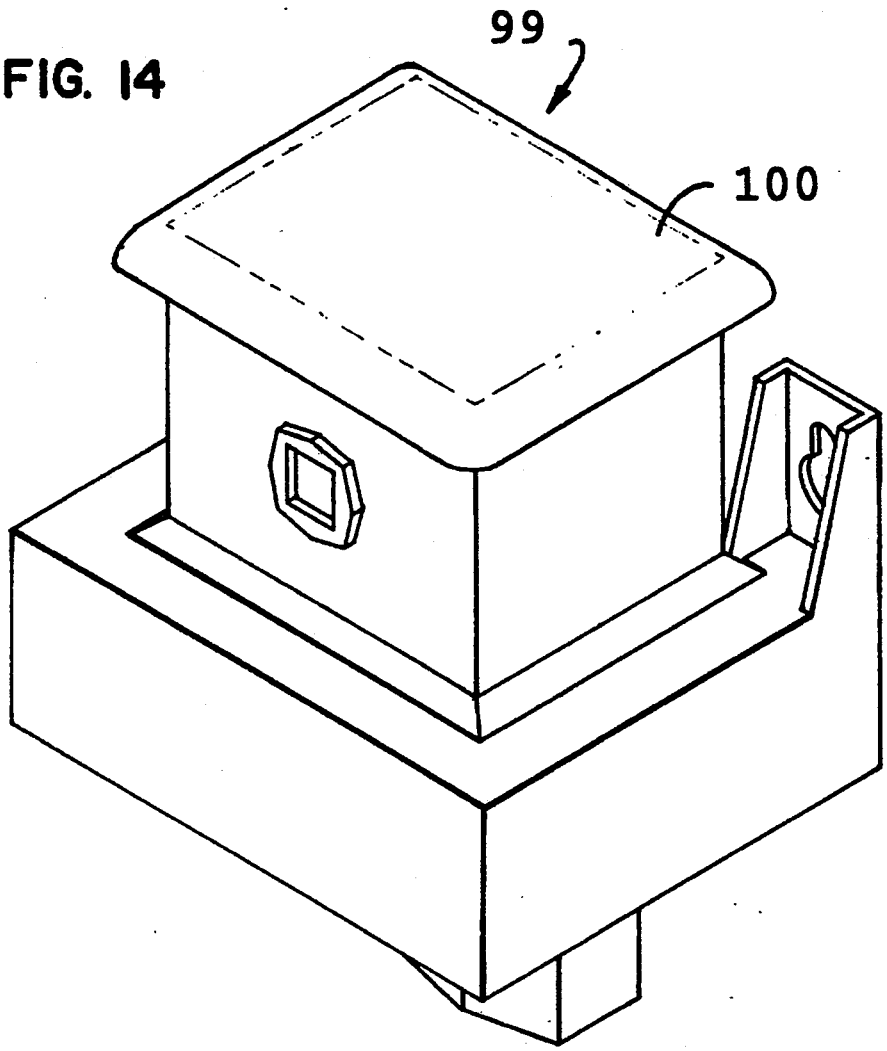
FIG. 14 is a perspective view of a fully encapsulated power supply having an integral component compartment.

The peripheral or support devices are then assembled to the encapsulated transformer, such as dropping or plugging an electronic control card or other device onto terminals, using such features as are provided for the assembly by the design of the encapsulant. If enclosure of the assembled devices is desired, a covering is then installed enclosing the device. The innovative end result is that the transformer becomes the housing for such support devices whether the device is technically within the encapsulant provided for electrical insulation of the transformer or beyond this volume. FIG. 14 illustrates one embodiment of a power supply 99 with a peripheral device housing 100.

It is to be understood that numerous and various modifications can be readily devised in accordance with the principals of the present invention by those skilled in the art without departing from the spirit and scope of the invention. Therefore, it is not desired to restrict the invention to the particular constructions illustrated and described but to cover all modifications that may fall within the scope of the appended claims.

We claim:

1. A high efficiency fully encapsulated power transformer apparatus comprising:

(a) a magnetic core member having a plurality of generally planar E and I core pieces, said core pieces being stacked such that planar surfaces of opposing core pieces generally abut one another;

(b) a unitary bobbin having a plurality of terminal receiving slot means, said bobbin having a first flange, a second flange, and a third flange, wherein said first and second flanges form a first winding form, and second and third flanges form a second winding form, said bobbin including walls forming a tapered central aperture for accepting and retaining said core pieces, said aperture being tapered on at least one wall that is generally parallel to said planar surfaces of said core pieces, whereby said core pieces are compressed in a direction generally perpendicular to the planar surfaces thereof, said bobbin having a plurality of extended tabs protruding from said first and third flanges;

(c) a first winding on said first winding form;

(d) a second winding on said second winding form;

(e) a terminal means inserted into said terminal slot means for electrical connection to said first and second windings; and (f) a bobbin and core member encapsulation formed of an encapsulant substantially covering and substantially conforming to said bobbin and said core member, said encapsulant being formed of a material selected from the group consisting of a thermoplastic material, a thermosetting material, or mixtures thereof.

2. The apparatus of claim 1 wherein said terminal means comprises:

(b) a body member including, (i) tang portion means for engagement with said transformer bobbin;

(ii) notched portion means for attachment to said transformer windings; and (iii) connector portion means for electrical interconnection; and (b) sealing means for preventing flashing of encapsulant along said connector portion means and for venting air along said connector portion.

3. The apparatus of claim 1, wherein said unitary bobbin further comprises a plurality of mold locating surfaces for accurately centering said apparatus within an encapsulation mold.

4. The apparatus of claim 1 wherein said unitary bobbin further comprises a primary and secondary passage within said bobbin for placement of an insulated electrical cord therein, said passages providing protection to said cored from the metal temperature of said encapsulant and providing strain relief for said cord.

5. The apparatus of claim 1 wherein said first and second windings comprise magnet wire formed of a material selected from the group consisting of copper, aluminum, or mixtures thereof.

6. The apparatus of claim 1 wherein said terminal means provides electrical connection between said winging and a lead wire.

7. The apparatus of claim 1 wherein said bobbin further comprises a ground wire passage, at least a portion of which is disposed within at lest one of said first, second and third flanges.

8. The apparatus of claim 1 wherein said bobbin is configured so as to cooperatively form an encapsulant flow passage and reception chamber with a mold during encapsulation, said encapsulant flow passage and reception chamber being configured to facilitate dispersion of said encapsulant.

9. The apparatus of claim 1 further comprising an integral component compartment formed during encapsulation, at least a portion of said compartment being located within said encapsulation.

10. The apparatus of claim 1 wherein said alternating core pieces comprise:

(a) first I and E core pieces made from cold rolled steel; and (b) second I and E core pieces made from silicon steel.

11. The apparatus of claim 1 wherein said alternating core pieces comprise:

(a) first I and E core pieces made from cold rolled steel; and (b) second I and E core pieces made from grain oriented silicon steel.

12. The apparatus of claim 1 wherein each of said I and E core pieces is formed with an alignment aperture formed therein, and wherein said encapsulation forms a first and second sprue rivet such that said first and second sprue rivets retain each of said I and E core pieces.

13. The apparatus of claim 1 wherein said bobbin comprises a polyethylene terephthalate material.

14. The apparatus of claim 1 wherein said encapsulant comprises a polyethylene terephthalate material.

15. The apparatus of claim 1, wherein at least one of said plurality of extended tables is a bobbin flange, operatively connected to said bobbin proximate said magnetic core member, for facilitating compression of said core pieces during encapsulation.

16. The apparatus of claim 15, wherein said bobbin flange is tapered along an interior surface for facilitating insertion of core pieces into said tapered aperture.

17. The apparatus of claim 7, wherein said bobbin further compriess a ground conductor, wherein said ground conductor is partially disposed within said ground wire passage and bent so as to be partially disposed within said aperture in a groove defined therein parallel to said planar surfaces of said core pieces, and wherein said core pieces compress and secure said ground conductor in said aperture and form an electrical connection between said core member and said ground conductor.

18. The apparatus of claim 8, wherein said encapsulant flow passage and reception chamber is configured to slow the flow of encapsulant into the mold.

* * * * * .